US009017089B2

(12) United States Patent
Flower et al.

(10) Patent No.: US 9,017,089 B2
(45) Date of Patent: Apr. 28, 2015

(54) ELECTRICAL CONTACT AND METHOD OF MANUFACTURE

(71) Applicant: Harwin PLC, Hampshire (GB)

(72) Inventors: Scott Flower, Hampshire (GB); Andrew McQuilken, Hampshire (GB); Mark Plested, Hampshire (GB)

(73) Assignee: Harwin PLC, Hamphire (GB)

( * ) Notice: Subject to any disclaimer, the term of this patent is extended or adjusted under 35 U.S.C. 154(b) by 92 days.

(21) Appl. No.: 13/848,813

(22) Filed: Mar. 22, 2013

(65) Prior Publication Data

US 2013/0260596 A1 Oct. 3, 2013

(30) Foreign Application Priority Data

Mar. 22, 2012 (GB) ..... 1205109.0

(51) Int. Cl.

| | |
|---|---|
| ***H01R 13/625*** | (2006.01) |
| ***H01R 4/50*** | (2006.01) |
| ***H01R 4/00*** | (2006.01) |
| ***H01R 13/11*** | (2006.01) |
| ***H01R 43/16*** | (2006.01) |
| ***H01R 13/62*** | (2006.01) |

(52) U.S. Cl.

CPC ..... *H01R 4/00* (2013.01); *Y10T 29/49204* (2015.01); *H01R 13/111* (2013.01); *H01R 43/16* (2013.01); *H01R 13/62* (2013.01)

(58) Field of Classification Search

CPC ..... H01R 4/00; H01R 43/16; H01R 13/62; H01R 13/111; Y10T 29/49204

USPC ..... 439/345, 883; 29/874

See application file for complete search history.

(56) References Cited

U.S. PATENT DOCUMENTS

| | | | | |
|---|---|---|---|---|
| 4,293,181 | A | 10/1981 | Lacaze, Jr. | 339/258 R |
| 4,693,533 | A | 9/1987 | Szczesny et al. | 439/350 |

(Continued)

FOREIGN PATENT DOCUMENTS

| | | | | |
|---|---|---|---|---|
| EP | 2 362 493 | A1 | 8/2011 | H01R 13/11 |
| EP | 2 385 585 | A1 | 11/2011 | H01R 13/11 |
| GB | 2 248 565 | A | 4/1992 | H01R 43/16 |
| JP | 2010153160 | A | 8/2010 | H01R 13/639 |
| WO | 2009/016243 | * | 2/2009 | |

OTHER PUBLICATIONS

Search Report from corresponding application No. GB1205109.0 mailed Sep. 4, 2013.

(Continued)

*Primary Examiner* — Javaid Nasri

(74) *Attorney, Agent, or Firm* — Renner Kenner Greive Bobak Taylor & Weber

(57) ABSTRACT

In one embodiment is provided a method of manufacturing a female electrical contact from a piece of material by removal of material from the piece of material by machining. The removal of material comprises forming at least one first hole in a first end of the material to form a contact portion, the at least one first hole formed along a longitudinal axis; making at least two slits in the contact portion to produce contact fingers, the slits extending from the first end along at least a portion of length of the contact portion. A corresponding single piece female contact is provided. Another embodiment provides a latching mechanism for an electrical connector housing, the latching mechanism comprising: a planar body portion; a neck portion extending in a first direction from one end of the body portion, the neck portion including a raised portion; and a locking member.

12 Claims, 22 Drawing Sheets

(56) References Cited

U.S. PATENT DOCUMENTS

| | | | | |
|---|---|---|---|---|
| 4,810,214 | A | 3/1989 | Yohn | 439/842 |
| 6,152,787 | A | 11/2000 | Serbin et al. | 439/852 |
| 7,192,297 | B1 | 3/2007 | Wu | 439/358 |
| 8,782,883 | B2 * | 7/2014 | Shimizu | 29/882 |
| 2006/0110972 | A1 | 5/2006 | Wu | 439/358 |
| 2008/0318462 | A1 | 12/2008 | Gerard et al. | 439/353 |
| 2009/0264009 | A1 | 10/2009 | Wang et al. | 439/495 |
| 2011/0256759 | A1 * | 10/2011 | Kunes et al. | 439/578 |

OTHER PUBLICATIONS

Search Report from corresponding application No. GB1205109.0 mailed Jul. 20, 2012.

Search Report from corresponding application No. EP 13159969.8 mailed Jul. 1, 2013.

* cited by examiner

ELECTRICAL CONTACT AND METHOD OF MANUFACTURE

TECHNICAL FIELD

The present invention relates to electrical contacts and a method of manufacture of such contacts. In particular, the present invention relates to high-reliability miniature electrical contacts and a method of manufacturing the same. The present invention also relates to housings that may be used to house these high-reliability miniature electrical contacts and latches for said housings.

BACKGROUND ART

An electrical connection can be made between two electrical devices, usually using a male and female electrical contact. One part of the connection has a male contact with an electrical pin and the other part is a female contact in the form of a socket for receiving the male contact.

Known female contacts include a female contact formed of a cylindrical base, the base having a stamped four finger clip inserted into one end. Examples of such known contacts are those of the Datamate and Micro D range that are manufactured by Harwin PLC. One problem with this type of contact is that, on a miniature scale, it is difficult to form the base and clip because these must be formed of very thin material that will not have the mechanical strength required to survive the insertion of the clip into the base. This problem is a significant barrier in the design and manufacture of complex miniature scale electrical contacts. In the present specification the term 'miniature' should be understood to mean length scales of the order of approximately a tenth of a millimeter up to a centimeter or so.

Known contacts are typically manufactured by stamping or die cutting one or more shapes out of a flat sheet of material and subsequently folding this shape up to form the finished contact. One such contact is disclosed in U.S. Pat. No. 6,152,787 to Serbin et al. The folding step in this process has to be done accurately and carefully to ensure that the contact produced is of precisely the correct shape and dimensions. Further, after the folding step some sort of joining, sealing, gluing or welding must take place to form the finished contact.

SUMMARY OF THE INVENTION

The electrical contacts of the present invention are formed of a single machined item. As used herein the term 'machined' refers to the subtractive manufacturing process where material is physically removed from a starting piece, such as bar stock, to achieve a desired geometry. Therefore, as used herein, the terms 'machined' or 'machining' are intended to distinguish from operations performed on a flat sheet of material, such as stamping or die cutting.

From a first aspect, the present invention provides a first female electrical contact and a method of manufacturing the same. In particular, the present invention provides a method of manufacturing a female electrical contact from a single piece of material, wherein a contact portion is formed by removal of material from the piece of material by machining. The present invention also provides a single piece female electrical contact having a contact portion, wherein the contact portion is formed by removing material from a piece of starting material by machining.

The female electrical contact may include a series of protrusions formed on a part of the outer surface thereof. These protrusions may be formed by knurling. The female electrical contact may additionally or alternatively include a further protrusion in its outer surface, which may extend around the entire circumference of the contact. The female electrical contact may additionally or alternatively include a tail formed from the starting material, which tail may extend from the end of the piece of material that is distal the contact portion of the contact. The female electrical contact may additionally or alternatively include a through hole, which may be plated along at least one interior surface. The plating may include a nickel undercoat and a gold topcoat. The material that the female electrical contact is manufactured from may be electrically conductive.

From a second aspect, the present invention provides a second female electrical contact and a method of manufacturing the same.

From a third aspect, the present invention provides a first male contact that is suitable for mating with the female contact of the first aspect or the female contact of the second aspect. The first male contact may be a miniature contact and includes a body portion and a contact portion, the body portion having a cross hole at a point around its outer surface. Preferably the cross hole provides access to the interior of the male contact, to allow at least a portion of the interior of the male contact to be plated. More preferably the cross hole provides access to a blind hole within the interior of the male contact, such that access to the interior of the contact is provided through the cross hole via the blind hole.

From a fourth aspect, the present invention provides a second male contact that is suitable for mating with the female contact of the first aspect or the female contact of the second aspect. The second male contact includes a body portion having at least one protrusion on its surface. Preferably the at least one protrusion is dimensioned and/or positioned to interface with at least one recess in a connector.

From a fifth aspect, the present invention provides a first connector housing that can be used to house the contacts of the first and third aspects. In particular, the present invention provides a connector housing, the connector housing comprising a first connector and second connector, the first and second connectors being secured together by the latching mechanism according to the seventh or eighth aspects.

At least one of the connectors may include a bending edge. Additionally or alternatively at least one of the connectors may include at least one hole into which a contact can be inserted, the at least one hole having at least one protrusion within it that is shaped such that it will interference fit with a corresponding recess on the outer surface of the contact. Additionally or alternatively at least one of the connectors may include a slotted portion for accepting a part of a neck portion of a latch. Additionally or alternatively at least one of the connectors may include a groove that abuts a first locking member of a latch and/or a lip portion that abuts a second locking member of a latch. Additionally or alternatively a pair of curved protrusions may be provided on each end face of at least one of the connectors, the curved protrusions defining a gap into which a latch can be accepted. At least one of the connectors may be formed from polytetramethylene terephthalamide. At least one of the connectors may house a contact manufactured according to the present invention.

From a sixth aspect, the present invention provides a second connector housing that can be used to house the contacts of the second and fourth aspects.

From a seventh aspect, the present invention provides a first latching mechanism suitable for use with the housing of the fifth or sixth aspect. In particular, the present invention provides a latching mechanism for an electrical connector housing, the latching mechanism comprising a planar body portion; a neck portion extending in a first direction from one end of the body portion, the neck portion including a raised portion; and a locking member.

The body portion of the latching mechanism may include at least one pair of protrusions extending from the body portion in a second direction. Two pairs of such protrusions may be provided, wherein the first is proximate the neck portion and the second is distal the neck portion. The extent of the first pair of protrusions in the first direction may be less than the extent of the second pair of protrusions in the second direction. The component of the second direction that lies in the plane of the body portion may be perpendicular to the component of the first direction that lies in the plane of the body portion. Both of the first and second directions may lie in the plane of the body portion. The latching mechanism may additionally or alternatively include a surface mount pad or at least one pair of through board legs. The latching mechanism may be formed from a resiliently deformable material, which may be at least one of a copper alloy and stainless steel.

From an eighth aspect, the present invention provides a second latching mechanism suitable for use with the housing of the fifth or sixth aspect.

BRIEF DESCRIPTION OF THE DRAWINGS

Embodiments of the invention will now be provided by way of example only with reference to the drawing in which.

BEST MODE FOR CARRYING OUT THE INVENTION

Figure 1:
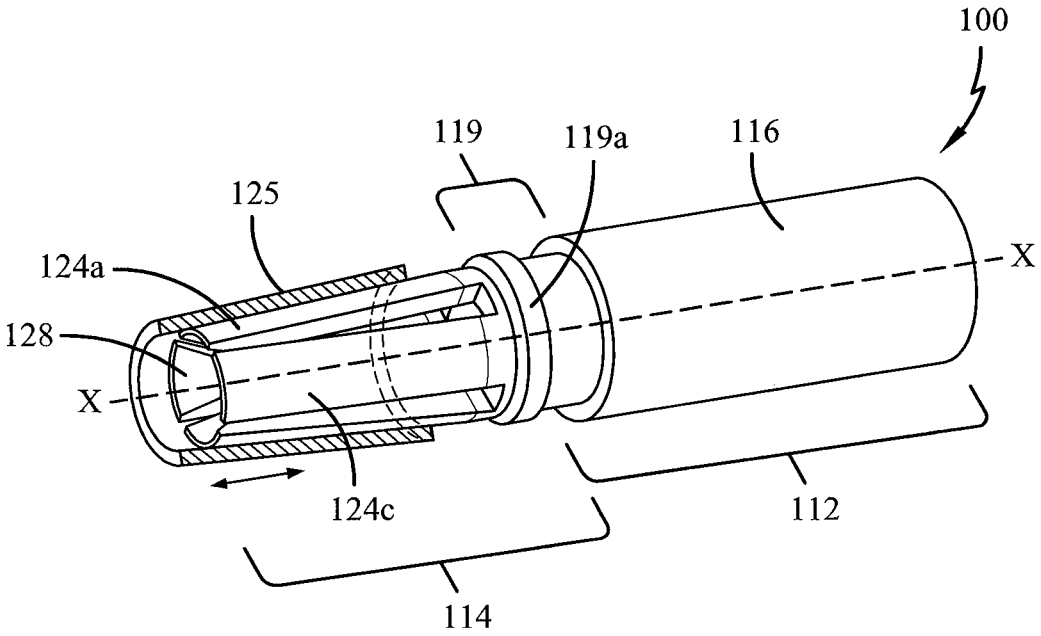
FIG. 1 shows a perspective view of a female contact and a tapered sleeve in cross-section in accordance with a first embodiment.

A miniature female contact 100 according to the first embodiment will now be described with reference to FIGS. 1, 1A and 1B. In the present embodiment contact 100 has an outer diameter of around 1.mm, but the present invention is not limited to this and it will be readily apparent to the skilled person that miniature contacts having other diameters may also be produced after consideration of the teaching herein. The typical exemplary dimensions are provided to outline the miniature extent of contacts that can provided by the present invention.

Contact 100 will be described herein in terms of a body portion 112 and a contact portion 114, but it is important to note that this distinction is purely artificial for ease of description only; that is, contact 100 is formed from a single piece of material that includes body portion 112 and contact portion 114. Stated alternately, contact portion 112 is integral with contact portion 114 forming a single piece contact; that is, there are no gaps, breaks, interfaces or discontinuities between body portion 112 and contact portion 114. Preferably contact 100 is formed of electrically conductive material such as beryllium copper, but other suitable materials known to the skilled person may be used.

Manufacturing contact 100 as a single piece contact eliminates secondary assembly operations and improves the electrical performance of the contact, since it reduces unwanted increases in contact resistance caused by e.g. changes of material or electroplating finishes.

Body portion 112 is substantially cylindrical and includes a barrel 116 that is centered on the longitudinal axis X of body portion 112. Barrel 116 is open at one end, this end being distal contact portion 114, to allow access to its interior. The interior surface of barrel 116 is contoured to form a receptacle. For ease of description the receptacle will be described in terms of two portions; a receptacle outer portion 118*a* and a receptacle inner portion 118*b*, although it should be understood that no gaps, breaks, interfaces or discontinuities are present between receptacle outer portion 118*a* and receptacle inner portion 118*b*.

Receptacle outer portion 118*a* is adjacent the open end of barrel 116 and receptacle inner portion 118*b* is adjacent receptacle outer portion 118*a* and is thus wholly contained within barrel 116. In the present embodiment the interior surface of barrel 116 is contoured such both receptacle outer portion 118*a* and receptacle inner portion 118*b* have a substantially cylindrical cross-section, with the diameter of receptacle outer portion 118*a* being larger than the diameter of receptacle inner portion 118*b*. In the present embodiment receptacle outer portion 118*a* is shorter in axial length than receptacle inner portion 118*b*.

The profile of the interior surface of barrel 116 allows a wire (not shown) to be received in the interior of barrel 116 via its open end. The wire is fed into receptacle outer portion 118*a* and receptacle inner portion 118*b*. Preferably a stripped (non-insulated) portion of the wire is positioned in receptacle inner portion 118*b* and a covered (insulated) portion of the wire is positioned in receptacle outer portion 118*a*. Arrangement of the wire in this manner advantageously allows the receptacle to act as a strain relief system for the wire.

Once the wire is in place, substantially uniform force is applied along and around the portion of the outer surface of barrel 116 that is aligned with receptacle inner portion 118*b*. This causes receptacle inner portion 118*b* to compress and in doing so secures the stripped portion of the wire in barrel 116 and ensures that a good electrical connection is made. This compression (or crimping) may be achieved using any tool known by the skilled person that is appropriate for the task, such as an 8 point indentation tool.

It should be understood that the interior profile of barrel 116 described above is purely exemplary and the interior of barrel 116 may define any other profile that is suitable for receiving a wire.

As mentioned earlier body portion 112 is substantially cylindrical. However a recessed portion 119 is located in the outer surface of body portion 112 at the end of body portion 112 that is proximate contact portion 114. Recessed portion 119 has a protrusion 119*a* along part of its length, with both recessed portion 119 and protrusion 119*a* being positioned to align with complimentary features in a housing (described later) in which contact 100 is secured. In the present embodiment protrusion 119*a* extends around the entire circumference of body portion 112.

In the interior of body portion 112 and adjacent receptacle inner portion 118*b* is a through hole 120. Adjacent through hole 120 is a drilled cavity 122. Both through hole 120 and drilled cavity 122 are centered on the longitudinal axis X of body portion 112. Like receptacles 118*a* and 118*b*, the extents of through hole 120 and drilled cavity 122 are defined by the contours of the inner surface of body portion 112. In the present embodiment through hole 120 and drilled cavity 122 both have a substantially cylindrical shape, although other shapes may be used for either feature.

Through hole 120 has a diameter smaller than that of receptacle inner portion 118*b*, although other cross-sectional profiles and diameters may be used. The shape and dimensions of drilled cavity 122 are selected to allow a male pin (not shown) to fit snugly and securely within it. There are no gaps, breaks, interfaces or discontinuities in the portion of the interior surface of body portion 112 that defines receptacle inner portion 118*b* and through hole 120, and similarly no gaps, breaks, interfaces or discontinuities in the portion of the interior surface that defines through hole 120 and drilled cavity 122.

Through hole 120 and drilled cavity 122 allow access to the interior of body portion 112 (and consequently barrel 116) from the end of body portion 112 that is proximate contact portion 114. This is so that, in use, a male pin sits within contact portion 114, drilled cavity 122 and through hole 120 and is in electrical contact with the wire (not shown) via the stripped portion of the wire that is housed in receptacle inner portion 118*b*.

Through hole 120 is provided to allow at least some of and typically substantially all of the entire internal surface of body 112 to be plated, which improves the electrical contact between a male pin and contact 100 when in use. Known contacts use blind holes for this purpose which typically provide poor plating coverage at best. The provision of through hole 120 therefore improves the plating coverage of the interior surface of body 112 and consequently improves the reliability of contact 100. Preferably the plating comprises a nickel undercoat and a gold topcoat, but other platings known to the skilled person can be used.

Figure 1A:
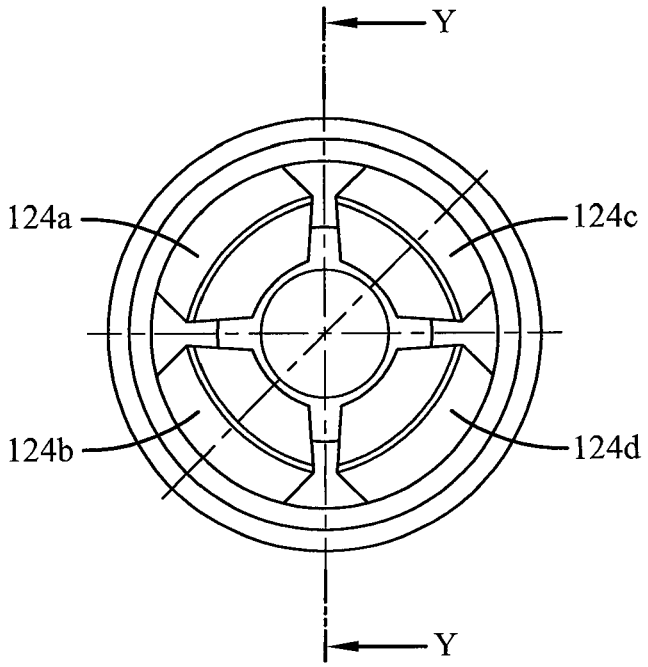
FIG. 1A shows a view from the contact finger end of the female contact of FIG. 1.

Turning now to contact portion 114, in the present embodiment this comprises four fingers 124*a*, 124*b*, 124*c* and 124*d* (only two of which are shown in FIG. 1; all four are shown in FIG. 1A), but it will be appreciated that any other number of fingers can be present. Each of the fingers is identical to all of the others, such that only one finger 124*a* will be described in detail here. In the present embodiment the diameter of contact portion 114 at its widest point is 0.86 mm, but this is purely exemplary and a contact portion having any other diameter is also within the scope of the present invention. The design of contact portion 114, and in particular fingers 124*a*, 124*b* . . . , advantageously reduces the force required to insert a male pin into contact 100. This improves the useable lifetime of contact 100, as a lower insertion force results in a lower stress to contact 100 each time it is mated with a male contact.

Finger 124*a* is formed of a sheet of material that extends away from the end of body portion 112 that contains drilled cavity 122. Finger 124*a* is joined to body portion 112 at one end, without the presence of any gaps, breaks, interfaces or discontinuities at the joint.

In the present embodiment finger 124*a* has the profile of a hollow frustum of a cone that has been cut into quarters along the length of its longitudinal axis, where the longitudinal axis of the frustum is aligned with the longitudinal axis X of body portion 112. Finger 124*a* is at an angle relative to the longitudinal axis X of body portion 112, such that finger 124*a* converges towards this longitudinal axis X when moving from the base of finger 124*a* (the base of finger 124*a* being joined to body portion 112) towards the tip 128 of finger 124*a*.

In the present embodiment finger 124*a* is straight, but this is purely exemplary and fingers having bends, curves or deformations along their length may also be used. In the present embodiment the acute angle between the axis of finger 124*a* (as defined along its length) and the longitudinal axis of body portion 112 is set by adjusting the angle of the taper of a sleeve 125 that is temporarily placed over finger 124*a* during manufacture; in particular, the more acute the angle of the taper of sleeve 125, the larger the acute angle between the axis of finger 124*a* and the longitudinal axis of body portion 112. The sleeve 125 itself is tapered towards its longitudinal axis so that, when it is placed over finger 124*a* during manufacture, finger 124*a* is bent towards the longitudinal axis of body portion 112.

Tip portion 128 is located at the end of finger 124*a* that is distal body portion 112 and, in the present embodiment, comprises a tapered portion that tapers towards the longitudinal axis X of body portion 112, with the thinner end of the tapered portion forming the end of tip portion 128 (and hence the end of finger 124*a*). Tip portion 128 acts as a lead in or guide for a male pin (not shown) during mating, such that the male pin is more easily and readily inserted into contact portion 114. Other profiles of tip portion 128 may also be used so long as they are able to accommodate a male pin.

As shown in FIG. 1A, fingers 124*a*, 124*b* . . . are arranged at regular 90 degree intervals around the circumference of body portion 112. This arrangement is purely exemplary and other arrangements incorporating different numbers of fingers spaced at different angles and having regular or irregular angular distributions of fingers may also be used. In use, a male pin (not shown) is inserted within the cavity defined by fingers 124*a*, 124*b* . . . and is held in position by these fingers.

A regular arrangement of fingers is preferred because this evenly distributes the force exerted by the fingers on a male pin (not shown) when it is mated with female contact 100. In addition, such an arrangement provides high resilience to discontinuity when the connector system is subjected to vibration and shock. In the particular case of contact 100, the four fingers 124*a*, 124*b* . . . mean that the male pin (not shown) will always maintain at least two points of contact with female contact 100 even when the connector system is subjected to vibration or other such mechanical shock, meaning that a good electrical contact can be maintained even in such circumstances. A good electrical contact can also be maintained irrespective of the direction of the vibration or mechanical shock.

In addition, unlike prior art electrical contacts, fingers 124*a*, 124*b* . . . do not need to be flattened or otherwise shaped in order to reduce the force required when inserting a pin into contact 100. This is because providing fingers 124*a*, 124*b* . . . as four points of contact significantly reduces the force required to deflect each finger as a pin is inserted, because each finger behaves like a cantilever beam that is closer to the optimum flat profile. Each finger 124*a*, 124*b* . . . is thus only deflected a small amount when a pin is inserted, and so the onset of permanent set at the root of each finger is avoided. Additionally, rapid wear of either contact 100 or the male pin is avoided. This advantageously extends the operational lifetime of contact 100. Furthermore, the arrangement of the fingers ensures that a large surface area on both the male pin and female contact 100 is optimised to withstand successive multiple engagements of contacts.

Figure 1B:
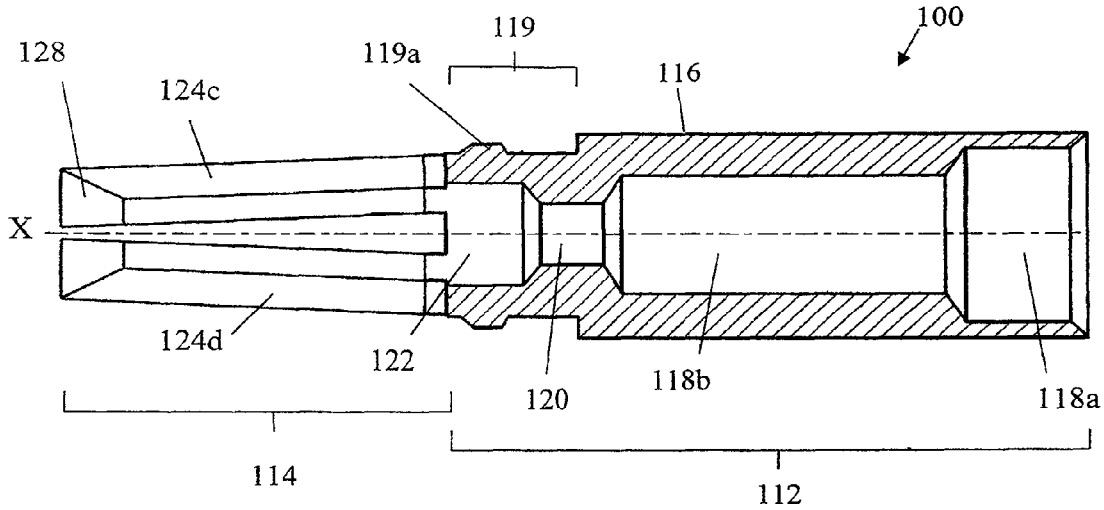
FIG. 1B shows a sectional view of the female contact of FIG. 1A taken along the line Y-Y.
Figure 1C:
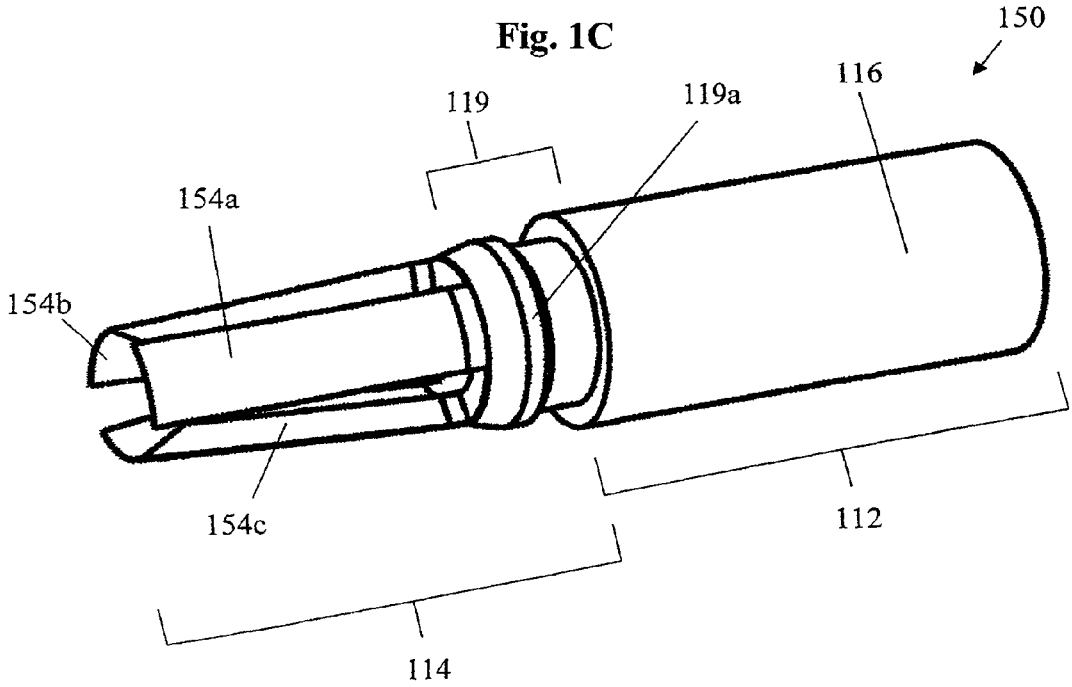
FIG. 1C shows a perspective view of a female contact similar to the female contact shown in FIG. 1.
Figure 1D:
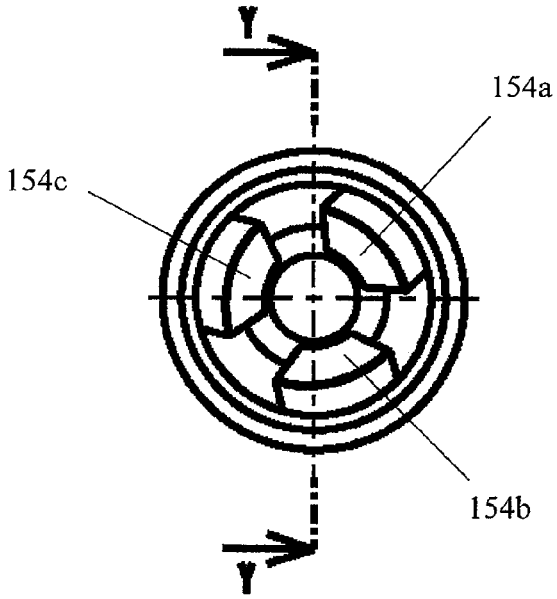
FIG. 1D shows a view from the contact finger end of the female contact of FIG. 1C.
Figure 1E:
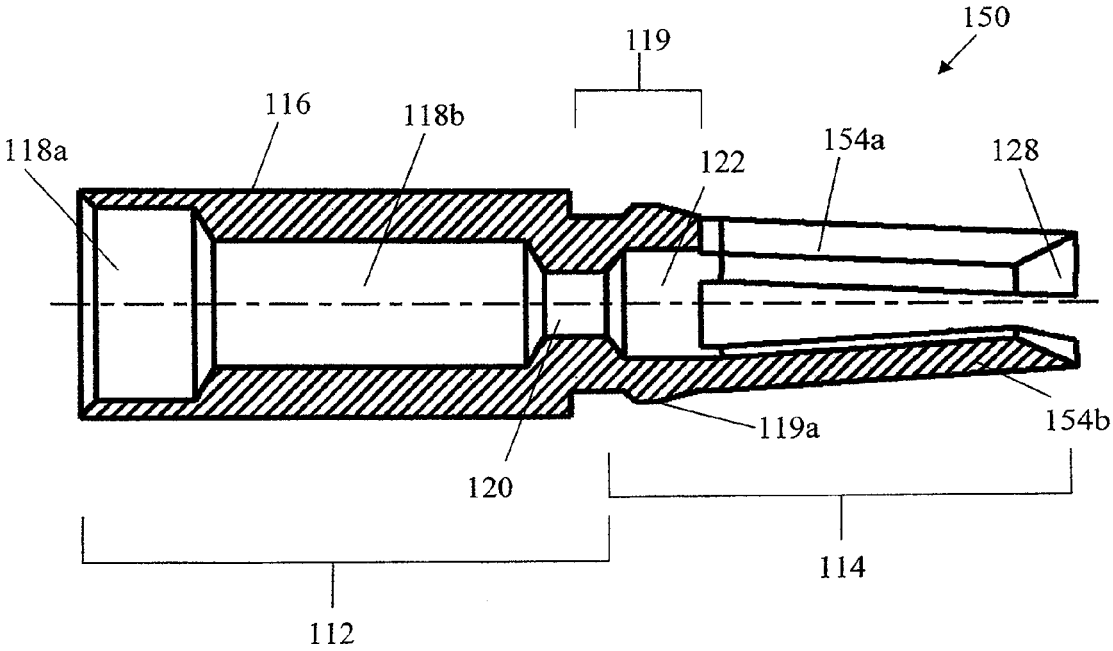
FIG. 1E shows a sectional view of the female contact of FIG. 1C taken along the line Y-Y.

A miniature female contact 150 similar to miniature female contact 100 is shown in FIGS. 1C, 1D and 1E, where like features have been given the same reference numerals as their counterpart in FIGS. 1A-1C. Like contact 100, contact 150 is also formed from a single piece of material.

The main difference between contact 150 and contact 100 is that contact 150 includes three fingers 154*a*, 154*b* and 154*c* that are arranged at regular 120 degree intervals around the circumference of body portion 112. However, it will be appreciated that arrangements having three irregularly spaced fingers are also within the scope of the present invention. Other than this, contact 150 is substantially identical to contact 100.

A method of manufacturing female contact 100 of the first embodiment will now be described.

In one embodiment, the female contact 100 is made from a single piece of material, and material is removed from this single piece of material to leave the body portion 112 within which a wire is received and the contact portion 114 with a plurality of fingers 124*a*,124*b*,124*c*,124*d* which received a male contact. The material is preferably removed by machining.

Figure 2:
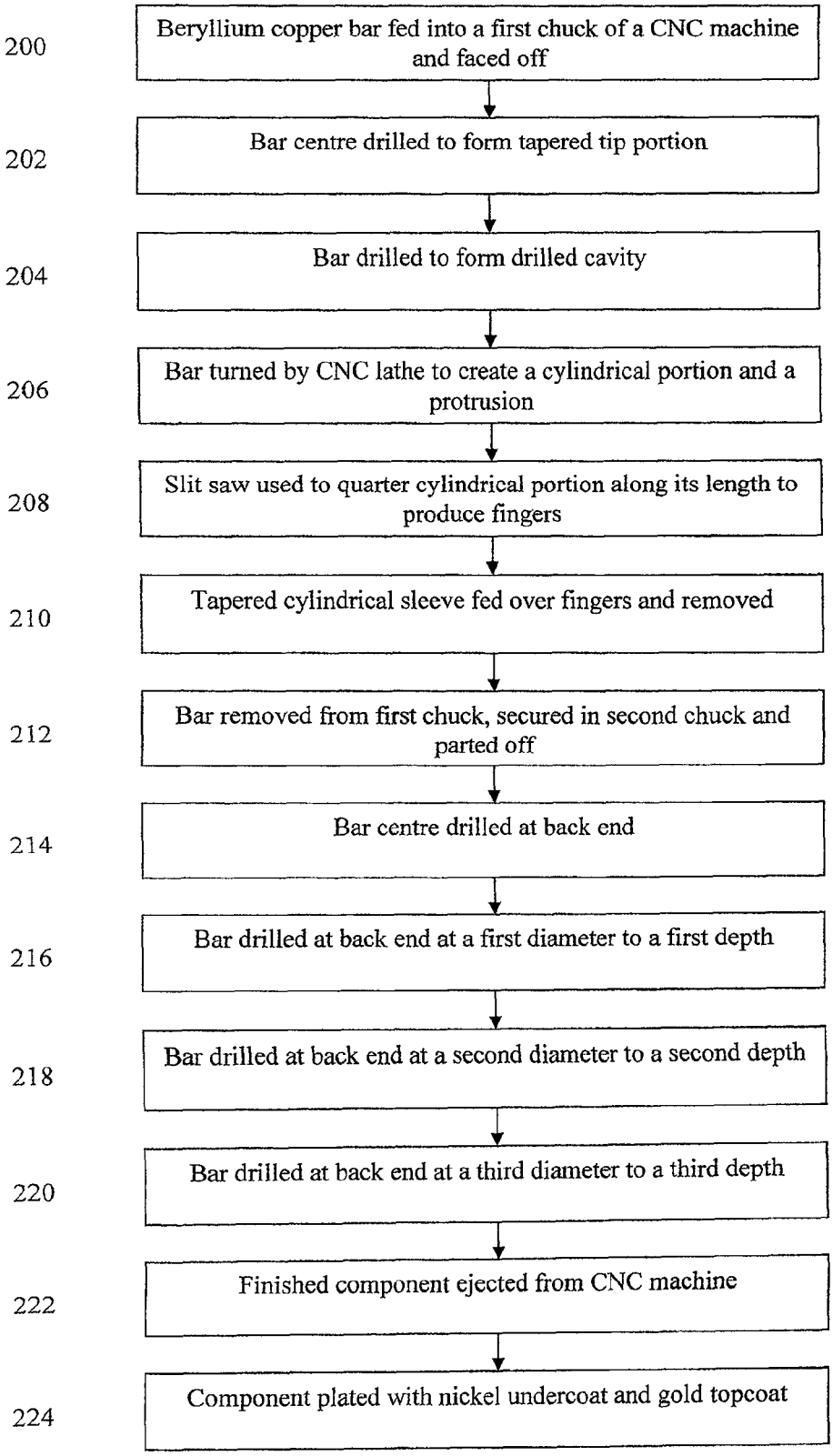
FIG. 2 is a flow diagram setting out the steps in a method for manufacturing the female contact of FIG. 1.

The method will now be described in more detail with reference to FIG. 2.

In step 200 a bar is fed into a Computer Numerical Control (CNC) machine, of the type well known to the skilled person, and secured in a first chuck. In the present embodiment the CNC machine is a STAR SR10J manufactured by Star CNC, but other suitable CNC machines may also be used. Further, in the present embodiment the bar is a 3.0 mm long beryllium copper rod that has a circular cross section, the cross section having a diameter in the range of 2.0 mm to 3.0 mm, but other materials, lengths and shapes of bar (e.g. any material falling under the category 'bar stock') may also be used.

Once the bar is inserted into the first chuck, a lathe is used to face off one end of the bar to form a substantially flat surface (step 200). A centre drill is then used in step 202 to form tip portion 128, where the centre drill bit is aligned with the longitudinal axis of the bar. The end of the bar in which tip portion 128 is formed is the end faced off in step 200 and will be referred to as the 'front' of the bar in the following description, and the face of the bar in which tip portion 128 is formed will be referred to as the 'front face'. The opposite end of the bar will be referred to as the 'back' end, having a corresponding 'back face'.

The centre drill bit is chosen to provide the desired length and taper for tip portion 128 and may be any centre drill bit known to the skilled person. In the present embodiment it is contemplated that all drilling is carried out using cylindrical drill bits, but drill bits having other shapes can also be used.

Once tip portion 128 is formed, drilled cavity 122 is created in step 204 at the front end of the bar and along its longitudinal axis, such that it a continuation of the smaller cavity created in step 202 that is tip portion 128. Drilled cavity 122 is created using a drill bit that has a smaller diameter than that of the centre dill bit used in step 202 to form tip portion 128. The shape, depth and diameter of drilled cavity 122 are chosen according to the size and shape of the male pin that is ultimately to mate with female contact 100.

The bar is then turned in step 206 using a CNC lathe to form a cylindrical portion, with the front face of the bar forming one face of the cylindrical portion. Turning is well known to the skilled person and will not be discussed further here. The cylindrical turned portion of the bar will become contact portion 114 in the finished article and is dimensioned accordingly so that a male pin will be able to be received with it. The CNC lathe is also used to form protrusion 119*a* in the outer surface of the cylindrical portion during step 206. Protrusion 119*a* is dimensioned and located appropriately along the cylindrical portion formed in this step to correspond to a groove in a housing in which the female contact of the present embodiment is to reside. In the present embodiment protrusion 119*a* is located near the end of cylindrical portion that is distal the front of the bar, but protrusion 119*a* can also be positioned elsewhere.

In step 208 the cylindrical portion is quartered along its length using a slit saw or other such suitable means to create fingers 124*a*, 124*b* . . . . Two identical slits are made, each at 90 degrees to the other, with the point of intersection of the slits being co-located with the centre of the front face of the bar. In the present embodiment each slit extends along the majority of the length of the cylindrical portion formed in step 206, stopping short of protrusion 119*a*. Other positions and numbers of slits may also be used.

In an alternative embodiment, three identical slits are made, each extending along at least a portion of the cylindrical portion formed in step 206, stopping short of protrusion 119*a*. The slits are circumferentially spaced by 120 degrees so that a contact similar to contact 150 is formed.

In step 210 a tapered cylindrical sleeve 125 is slid over the cylindrical portion to produce a uniform clenching of fingers 124*a*, 124*b* . . . ; that is, to cause fingers 124*a*, 124*b* . . . to become angled towards the longitudinal axis of the bar. The length of the tapered cylindrical sleeve 125 is chosen so that, when fully in place, one end of the cylindrical sleeve is close to, or in some cases abuts, protrusion 119*a*. The taper of the cylindrical sleeve 125 is chosen according to the amount of clenching of fingers 124*a*, 124*b* . . . that is required; this in turn is dictated by the diameter of the male pin that is ultimately to mate with the female contact of the present embodiment. In the present embodiment a sleeve 125 having a constant taper along its length is contemplated, but sleeves having a variable taper along their length may also be used. The tapered cylindrical sleeve is held in place a time sufficient to cause the desired uniform clenching of fingers 124*a*, 124*b* . . . and is then removed.

Once step 210 is complete, the bar is removed from the first chuck and secured in a second chuck such that the back end of the bar is accessible for machining. The bar is parted off in step 212 so that it has an overall length corresponding to the desired length of female contact 100 and is centre drilled in step 214 to form a lead in for subsequent drilling. The centre drill is aligned along the longitudinal axis of the bar such that the lead in is substantially co-located with the centre of the back face of the bar. In the present embodiment female contact 100 has an overall length of 4.45 mm, but the present invention is not so limited and contacts having any other length may also be manufactured using the method of this embodiment.

A series of three drilling steps, 216, 218 and 220, are then carried out to form receptacle outer portion 118*a*, receptacle inner portion 118*b* and through hole 120. A different drill bit is used for each step, with each drill bit being successively smaller in diameter than the last. Alternatively steps 216, 218 and 220 may be carried out in one step that uses a stepped drill bit. In each step the hole drilled is deeper than the last, with the length of the drill bit used in the final drilling step 220 being sufficient to drill a through hole into the cylindrical portion of the bar. The net result is a series of coaxial concentric cylindrical cavities centered along the longitudinal axis of the bar, such that a passage through the entire length of the bar is present.

In step 222 the bar is ejected from the CNC machine as a finished component and in step 224 the finished component is plated. In the present embodiment the plating comprises a nickel undercoat and a gold topcoat, as this has been found to provide a particularly good electrical connection, but any other platings known to the skilled person may be used. As mentioned earlier, through hole 120 advantageously allows the plating to be easily and uniformly distributed along the interior of contact 100.

The method of manufacturing female electrical contact 100 disclosed herein represents a significant improvement over known methods. A typical known method includes at least the following:

Using a CNC lathe to turn a shell for the contact body;

Using a press tool to press and stamp the fingers for the contact;

Heat treating the fingers to give them the required mechanical performance;

Plating the shell;

Plating the fingers; and

Assembling the entire contact by securing the fingers to the contact body.

It will be appreciated that the method of manufacture of the present embodiment is far simpler that such known methods, as it essentially comprises only:

Turning the contact using a CNC lathe; and

Plating a single portion of the interior of the contact.

This results in the method of the present embodiment offering a number of advantages over known methods, including but not limited to reducing the time required to manufacture each contact, reducing the manufacturing cost per contact due to fewer machines being required, reducing the cost and time required for retooling, improving the performance of the contacts due to the improved method of plating disclosed herein and improving the durability of the contacts due to the one-piece design of the contact. The method of the present embodiment is also capable of producing miniature contacts that known methods would typically find difficult if not impossible to produce, due to the single piece construction of the contact removing the need to separately form miniature fingers that are mechanically strong enough to survive insertion into the contact body.

A miniature female contact according to the second embodiment will now be described with reference to FIGS. 3, 3A, 3B, and 3C. The contact, 300, has some similarities to contact 100 of the first embodiment, and these will be highlighted at the appropriate points in the following description. Contact 300 is particularly suited for use as a Surface Mount Tail (SMT) contact which is a type of contact well known to the skilled person.

Similarly to the first embodiment, for ease of description contact 300 will be artificially divided into three portions, body portion 312, contact portion 314 and tail 315. However, also as in the first embodiment, this division is purely artificial and it is important to understand that body portion 312, contact portion 314 and tail 315 are formed from a single piece of material that includes body portion 312, contact portion 314 and tail 315. Stated alternately, contact portion 314 and tail 315 are integral with body portion 312; that is, there are no gaps, breaks, interfaces or discontinuities between body portion 312, contact portion 314 or tail portion 315; Stated alternatively, contact 300 is a single piece contact.

In the present embodiment the combined length of body portion 312 and contact portion 314 is 3.30 mm, but other lengths are also within the scope of the present invention.

Preferably contact 300 is formed of beryllium copper, but other suitable materials known to the skilled person may be used. More preferably the beryllium copper is unplated and burr free.

Contact portion 314 is similar to contact portion 114 of the first embodiment, so will not be described in further detail here. For ease of comparison FIG. 3 is labelled such that the numbering of features of contact portion 314 correspond to the same features of contact portion 114 of the first embodiment, but with the prefix '3' replacing the prefix '1'.

Figure 3:
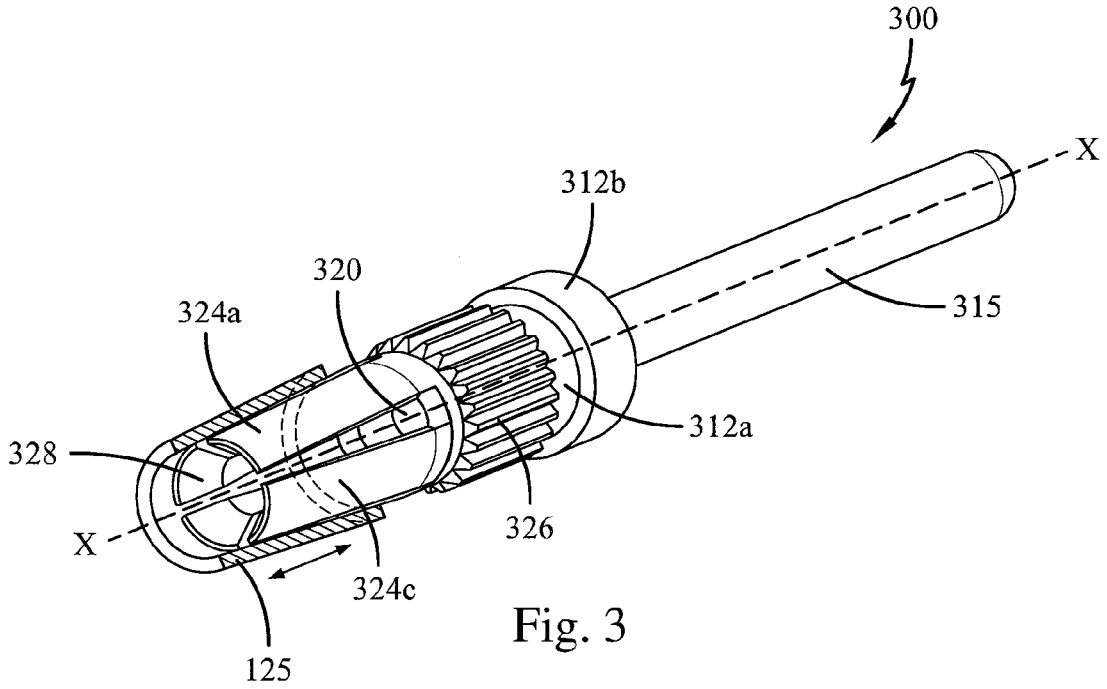
FIG. 3 shows a perspective view of another female contact and a tapered sleeve in cross-section in accordance with a second embodiment.

Body portion 312 of contact 300 is formed of a solid piece of material having a profile as shown most clearly in FIG. 3. The profile of body portion 312 resembles a pair of coaxial cylinders arranged end-to-end, where the first cylinder 312*a* is longer than the second cylinder 312*b*, with the longer first cylinder 312*a* having a smaller diameter than the shorter second cylinder 312*b*. In the present embodiment cylinder 312*b* is 1.00 mm in diameter, but this is not essential and cylinder 312*b* may have any other diameter. This outer profile is selected to compliment the grooves of a housing (described in detail later), such that contact 300 fits snugly and securely in this housing. The outer profile shown in FIG. 3 is purely exemplary and other outer profiles may be contemplated, so long as they compliment the housing in which contact 300 is to reside.

The shorter second cylinder 312*b* is located at the end of body portion 312 that is distal contact portion 314, with the longer first cylinder 312*a* being located between the shorter second cylinder 312*b* and contact portion 314. The outer diameter of the shorter second cylinder 312*b* is chosen such that, when contact 300 is placed in a housing (as described later), the cylinder abuts a portion of the housing to impede further movement of contact 300 into the housing once contact 300 is correctly positioned within the housing. Shorter second cylinder 312*b* therefore acts as a so-called 'positive stop' mechanism.

Extending from the centre of shorter second cylinder 312*b* is a tail 315 (shown discontinuously in FIG. 3; see break line 317). In the present embodiment tail 315 has a diameter of 0.40 mm, but this is not essential and any other diameter tail may also be contemplated. Tail 315 extends along the longitudinal axis of the shorter second cylinder 312*b* (and consequently along the longitudinal axis X of body portion 312) in the direction directly away from body portion 312. Tail 315 may be any length but typically will be at least as long as the combined length of body portion 312 and contact portion 314. In the present embodiment the length of tail 315 is in the range of 0.80 mm to 288.00 mm, but tails having other lengths outside this range are also within the scope of the present invention. Tails on the shorter end of this range are preferred for use on flexible circuit boards.

An end portion of tail 315 located at the distal end of tail 315 is a through board solder tail 315*a* of contact 300. Solder tail 315*a* is passed through a hole in a printed circuit board (PCB) (not shown) and then soldered in place to form an electrical path between the PCB and contact 300. Alternatively, solder tail 315*a* can be push fit into a plated through hole in the PCB.

Body portion 312 also contains a drilled cavity 322 that is centered on the longitudinal axis X of body portion 312 and positioned at the end of first cylinder 312*a* that is proximate contact portion 314. Drilled cavity 322 is similar to drilled cavity 122 of the first embodiment in that it is provided to accept a male pin (not shown) during mating. As in the first embodiment the shape and dimensions of drilled cavity 322 are chosen according to the dimensions of the male pin it is to accept.

Figure 3A:
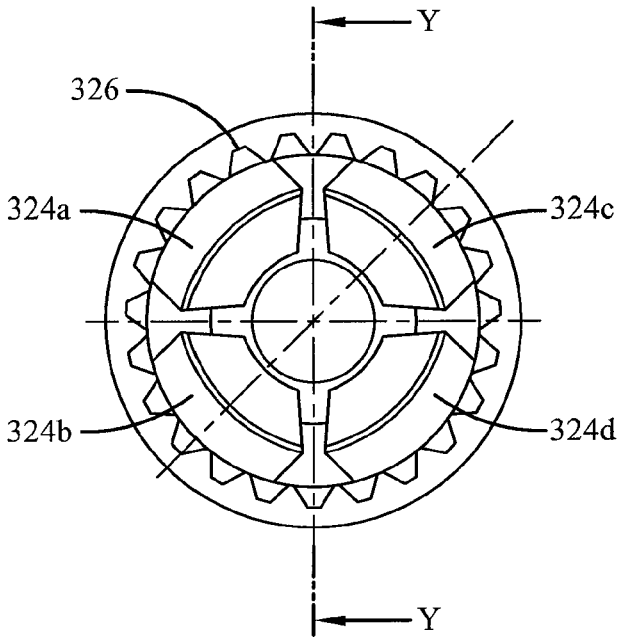
FIG. 3A shows a view from the contact finger end of the female contact of FIG. 3.
Figure 3B:
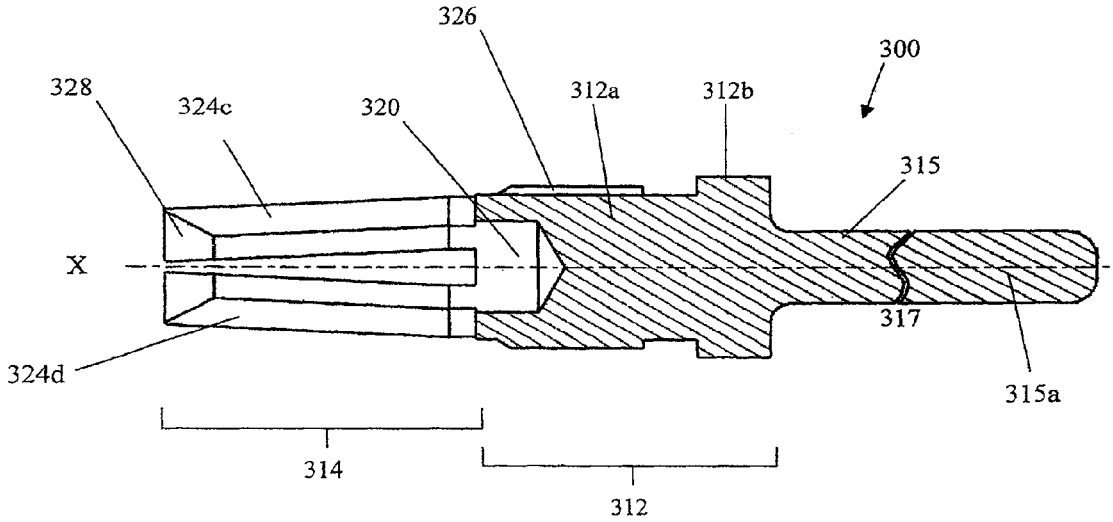
FIG. 3B shows a sectional view of the female contact of FIG. 3A taken along the line Y-Y.
Figure 3C:
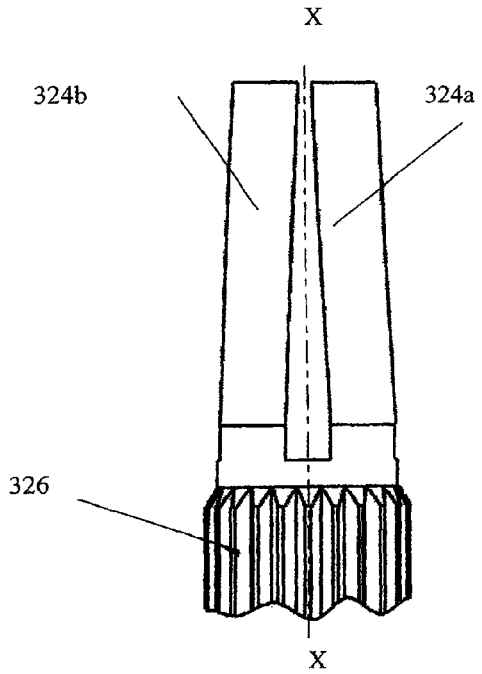
FIG. 3C shows a close up view of the contact portion of the female contact of FIG. 3.

As best shown in FIG. 3A, a portion of the outer surface of cylinder 312*a* is provided with a series of protrusions 326. Protrusions 326 are preferably formed by knurling and in the exemplary illustration of FIG. 3A are shown as a straight knurl. However, any other means known to the skilled person for forming similar or the same protrusions may be used, and both the configuration of the protrusions and the position of the protrusions along the length of body portion 312 may be varied without departing from the scope of the present invention. Preferably protrusions 326 are formed to interface with grooves formed in a housing designed to accommodate contact 300 (described in detail later) in an interference fit arrangement, such that the protrusions prevent contact 300 from rotating or sliding around in the housing.

In the present embodiment protrusions 326 are uniform and surround the entire circumference of body portion 312. As mentioned above this is a purely exemplary arrangement and other locations and arrangements of protrusions are also within the scope of the present invention. Alternatively, recesses may be positioned in the place of protrusions 326, with these recesses co-operating with corresponding protrusions on a housing.

Figure 4:
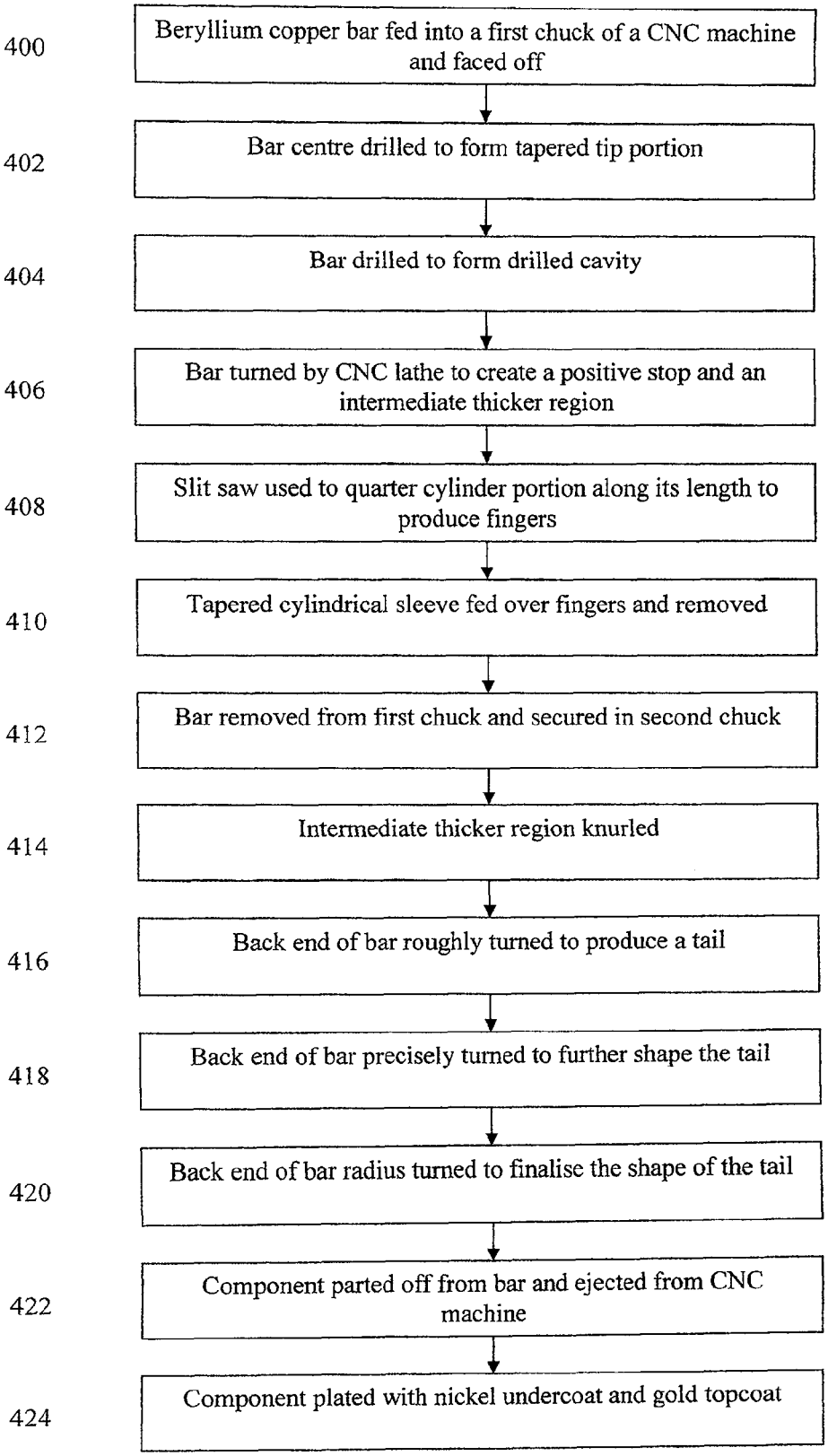
FIG. 4 is a flow diagram setting out the steps in a method for manufacturing the female contact of FIG. 3.

A method of manufacturing female contact 300 of the second embodiment will now be described with reference to FIG. 4. As in the first embodiment, the bar from which contact 300 is formed is a 3.0 mm rod of beryllium copper and the CNC machine used is a STAR SR10J manufactured by Star CNC. Other suitable machines and rod sizes may also be used.

Steps 400, 402 and 404 are similar to steps 200, 202 and 204 (respectively) as set out in the first embodiment and so will not be described in detail here. The same naming convention is adopted in the present embodiment as in the first embodiment; i.e. the end of the bar in which tip portion 328 is formed is the end faced off in step 400 and is referred to as the 'front' of the bar in the following description, and the face of the bar in which tip portion 328 is formed will be referred to as the 'front face'. The opposite end of the bar will be referred to as the 'back' end, having a corresponding 'back face'.

In step 406 the bar is turned using a CNC lathe such that a cylindrical portion is formed towards the back end of the bar. This cylindrical portion corresponds to second cylinder 312*b* ('positive stop') of the present embodiment. The location of the cylindrical portion with respect to the length of the bar is chosen such that it co-operates with a housing to act as a positive stop when contact 300 is fed into the housing; that is, the cylindrical portion acts to prevent contact 300 from being inserted too far into the housing.

In addition to the cylindrical portion, the bar is turned such that a thicker portion is present around its circumference at a position intermediate the cylindrical portion and the front end of the bar. Protrusions 326 will be formed on this intermediate thicker portion in a later step. The length (i.e. the extend in the axial direction of the bar) of the thicker intermediate portion is chosen such that protrusions 326 that are to cover it are of the right length to co-operate with grooves in a housing in which contact 300 is to be placed.

In steps 408 and 410 the fingers 324*a*, 324*b* . . . are formed. These steps are similar to steps 208 and 210 of the first embodiment and as such will not be described in further detail here.

In step 412 the bar is removed from the first chuck and secured in a second chuck such that the back end of the bar is accessible for machining. Unlike the first embodiment the bar is not parted off at this time; instead it has been found that working with a bar approximately three times the size of contact 300 improves the bar handling capabilities of the CNC machine and consequently results in a contact that is more precisely machined.

After the bar is placed in the second chuck, in step 414 protrusions 326 are formed on the thicker intermediate portion created in step 406. In the present embodiment protrusions 326 are formed by knurling, but other methods of creating protrusions may also be used. The back end of the bar is then rough turned in step 416 to produce a feature having the general shape of tail 315; this shape is then refined by finish turning in step 418. The shape of tail 315 is finalised in step 420 via radius turning. In step 422 contact 300 is parted off from the bar and removed from the CNC machine. Contact 300 is then plated; in the present embodiment a nickel undercoat and a gold topcoat are used as plating, but other forms of plating may be used instead.

The method of manufacturing female electrical contact 200 disclosed herein offers at least the same advantages over known methods as noted earlier in respect of the method of the first embodiment.

Figure 5:
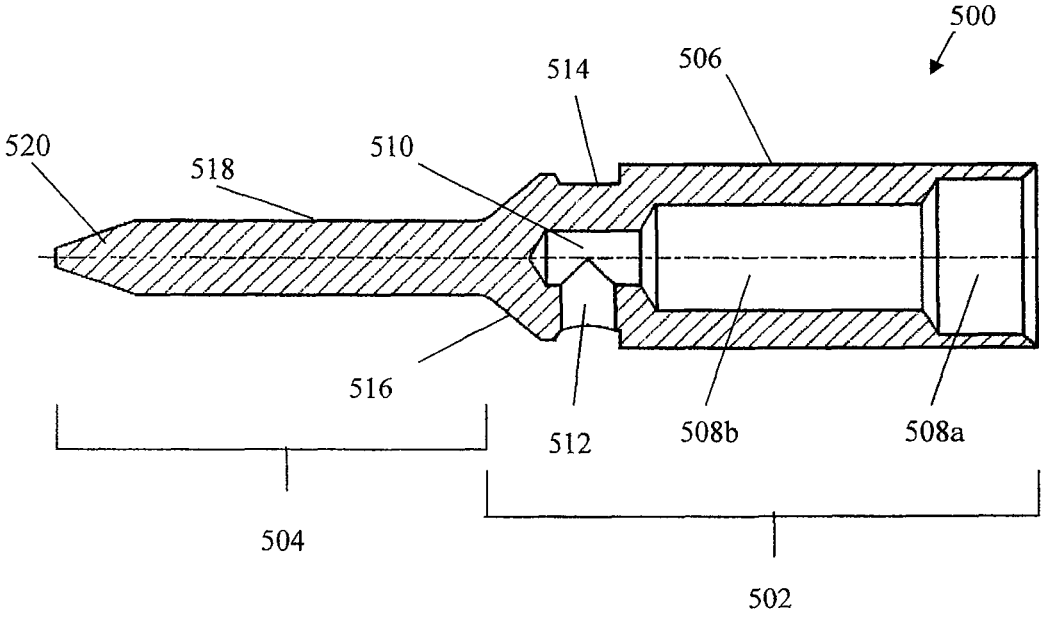
FIG. 5 shows a male contact in accordance with a third embodiment.
Figure 5A:
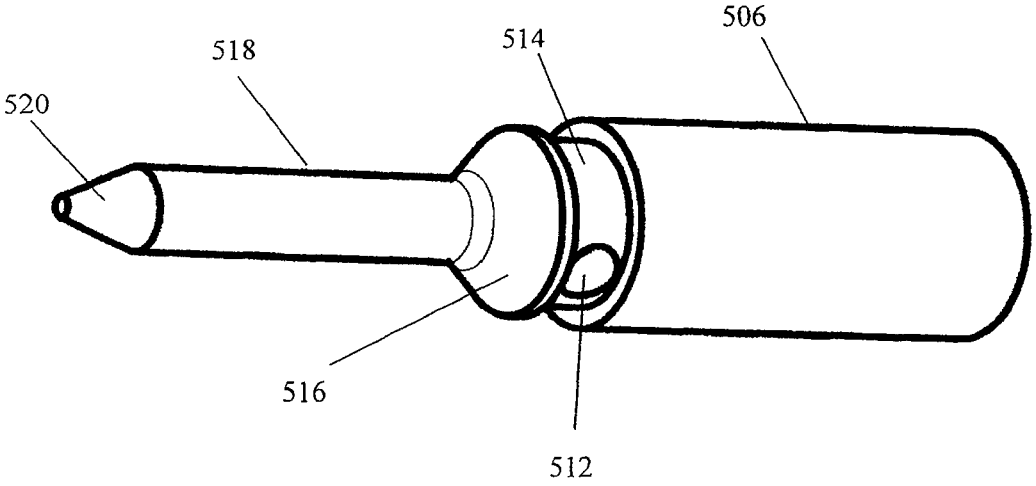
FIG. 5A is a perspective view of the male contact of FIG. 5.

A miniature male contact 500 according to the third embodiment will now be described with reference to FIGS. 5 and 5A. The miniature male contact of this embodiment is suitable for mating with female contact 100 of the first embodiment or female contact 300 of the second embodiment.

Like female contacts 100 and 300, male contact 500 is formed of a single piece of material; that is, it is a single piece contact. Preferably male contact 500 is formed of an electrically conductive material such as brass, but other materials may also be used. The miniature male contact 500 of the present embodiment is 1.00 mm in diameter and is 5.20 mm long, but the present invention is not limited to contacts of this diameter and/or length.

Male contact 500 has a body section 502 and a pin section 504. Pin section 504 mates with female contact 100 to provide an electrical connection between the wire housed in male contact 500 and the wire housed in female contact 100.

Body section 502 includes a barrel 506 having a receptacle outer portion 508*a* and a receptacle inner portion 508*b*. Barrel 506 is similar to barrel 116 of the first embodiment and receptacle outer portion 508*a* and receptacle inner portion 508*b* are similar to receptacle outer portion 118*a* and a receptacle inner portion 118*b*, respectively, of the first embodiment, so these features will not be described in further detail here. As in the first embodiment, receptacle outer portion 508*a* receives a covered (insulated) section of a wire and receptacle inner portion 508*b* receives a stripped (non-insulated) portion of the same wire.

At the end of receptacle inner portion 508*b* that is proximate pin section 504 is a blind hole 510 that is provided to allow receptacle outer portion 508*a* and receptacle inner portion 508*b* to be plated. In the present embodiment blind hole 510 is approximately cylindrical, but this shape is not crucial and blind holes having other shapes may also be used. The size and extent of blind hole 510 is also not crucial, as long as blind hole 510 provides access to receptacle inner portion 508*b*.

A cross-hole 512 is provided in a recessed portion 514 of the outer surface of body section 502. Recessed portion 514 extends around the entire outer circumference of body section 502 and is dimensioned to engage with a protrusion in a housing (described later) so as to secure contact 500 in place. In a preferred embodiment recessed portion 514 is the same as recessed portion 119 of female contact 100, such that female contact 100 and male contact 500 may be interchangeably housed in a single connector.

Cross-hole 512 is perpendicular to the longitudinal axis of body section 502 and is positioned in recessed portion 514 to provide access to blind hole 510 from the exterior of contact 500. The shape and size of cross-hole 512 is not crucial, so long as it provides access to blind hole 510 from the exterior of contact 500.

Cross-hole 512 improves the ease with which the internal surfaces of contact 500 (i.e. the walls of receptacle outer portion 508*a* and receptacle inner portion 508*b*, as well as blind hole 510 itself) are plated. In addition, cross-hole 512 improves the total plating coverage of these internal surfaces, such that substantially all of the internal surfaces are covered. This results in a high quality, reliable electrical connection being made between contact 500 and a wire (not shown) that is inserted into barrel 506. This is a significant improvement over known plating solutions that employ a blind hole, where typically little or none of the internal surfaces are plated and hence a poor electrical connection is made.

Between recessed portion 514 and pin section 504 the outer surface of body section 502 is tapered in the direction of pin section 504 towards the longitudinal axis of body section 502. This tapered portion 516 is substantially frustoconical and is dimensioned to engage with a recess in a housing (described later) so as to work with recessed portion 514 to secure contact 500 in place. The base of tapered portion 516 extends towards and abuts recessed portion 514, such that the overall profile of tapered portion 516 is that of a frustum of a cone having a thickened cylindrical base. The base of tapered portion 516 has a larger diameter than the diameter of recessed portion 514, so a lip is created between these two features. This aids in securing contact 500 in a housing and also ensures that contact 500 has substantially the same outer profile as contact 100, so they can be interchangeably housed in the same housing.

In the present embodiment the thickness of the base of tapered portion 516 is substantially less than the overall length of tapered portion 516, but this is not crucial and other thicknesses may be used. Preferably the thickness is chosen such that tapered portion 516 has the same outer profile size and shape protrusion 119*a* of female contact 100. More preferably barrel 506, recessed portion 514 and tapered portion 516 have the same outer profile size and shape as barrel 116, recessed portion 119 and protrusion 119*a*, such that contacts 100 and 500 can be interchangeably secured in a single housing; that is, a single housing profile can accommodate either of contacts 100 or 500.

The apex of tapered portion 516 is seamlessly connected to a pin 518 that forms the main part of pin section 502. The length and diameter of pin 518 is chosen such that it will just fit inside contact portion 514 of female contact 100 when the two are mated. In the present case pin 518 is cylindrical, but it will be appreciated that other shapes, such as cuboidal, may also be used for pin 518. Pin 518 is centered along the longitudinal axis of body section 502 and the end of pin 518 that is distal body section 502 is tapered towards the longitudinal axis of body section 502 to produce a frustoconical tip portion 520. Tip portion 520 is tapered such that is will engage with drilled cavity 122 of female contact 100 when contacts 100 and 500 are mated.

A miniature male contact 600 according to the fourth embodiment will now be described with reference to FIGS. 6, 6A, 6B and 6C. The miniature male contact of this embodiment is suitable for mating with either of female contact 100 of the first embodiment or female contact 300 of the second embodiment.

Figure 6:
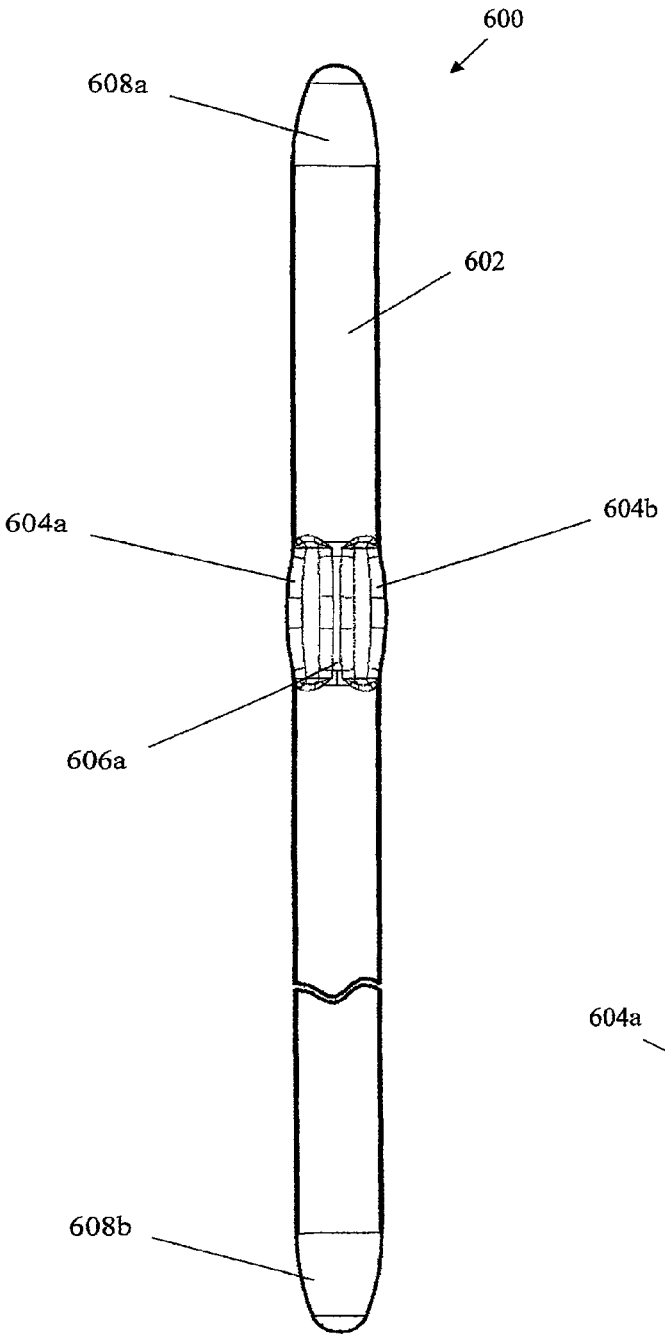
FIG. 6 shows a male contact in accordance with a fourth embodiment.
Figure 6A:
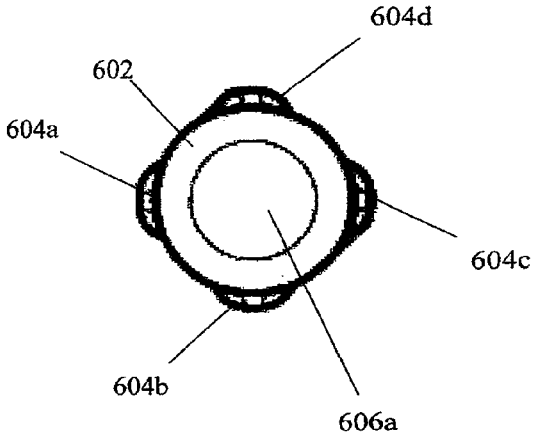
FIG. 6A shows a view from an end of the male contact of FIG. 6.

Contact 600 comprises a generally cylindrical body 602 having an alternating series of protrusions 604*a*, 604*b* . . . and recesses 606*a*, 606*b* . . . disposed on the outer surface of body 602 at an intermediate position along its length. In the present embodiment four protrusions and four recesses are provided (only two protrusions and one recess are shown in FIG. 6; FIG. 6A shows the protrusions most clearly), but this is not crucial and any number of recesses and protrusions may be provided. The length of body 602 is chosen such that contact 600 is sufficiently long to mate with contact 300 of the third embodiment and, once mated, have a portion of its length remaining outside contact portion 314 of contact 300 that is sufficiently long to be soldered to a PCB to form an electrical path. Further details on this point are provided later in this specification, where a housing suitable for accommodating mated contacts 300 and 600 is described.

Adjacent protrusions 604*a*, 604*b* . . . are each separated by a recess, such as recess 606*a*, where the recess is the same length at each protrusion and fills the entire space between them. Each protrusion is substantially identical to all of the other protrusions and each recess is substantially identical to all of the other recesses. In the present embodiment protrusions 604*a*, 604*b* . . . are disposed at 90 degree intervals around the circumference of body 602, such that the present embodiment has a four protrusion 'star' arrangement. However, this arrangement is not crucial to the invention and other arrangements of protrusions and recesses can also be used. In an alternative embodiment the recesses may be omitted entirely. In all embodiments the configuration, position along the length of body 602 and dimensions of protrusions 604*a*, 604*b* . . . and recesses 606*a*, 606*b* . . . (if present) are chosen such that the resulting arrangement will interference fit with corresponding recesses and protrusions in a housing (described later) to secure contact 600 in place within the housing.

At each end of body 602 is a tip portion 608*a*, 608*b*. Tip portion 608*a* is substantially identical to tip portion 608*b*, so only tip portion 608*a* will be described in detail here.

In the present embodiment tip portion 606*a* is frustoconical, with the apex of the frustum being rounded and forming an end of contact 600. The skilled person will recognise this shape as a 'bullet style' pin known in the art. However, this shape is not crucial to the invention and other shapes may also be used. Tip portion 606*a* is dimensioned such that, when contact 600 is mated with contact 300, tip portion 606*a* fits snugly within drilled cavity 322 of female contact 300.

In the present embodiment contact 600 is formed from phosphor bronze, but other suitable materials known to the skilled person may also be used.

Figure 6B:
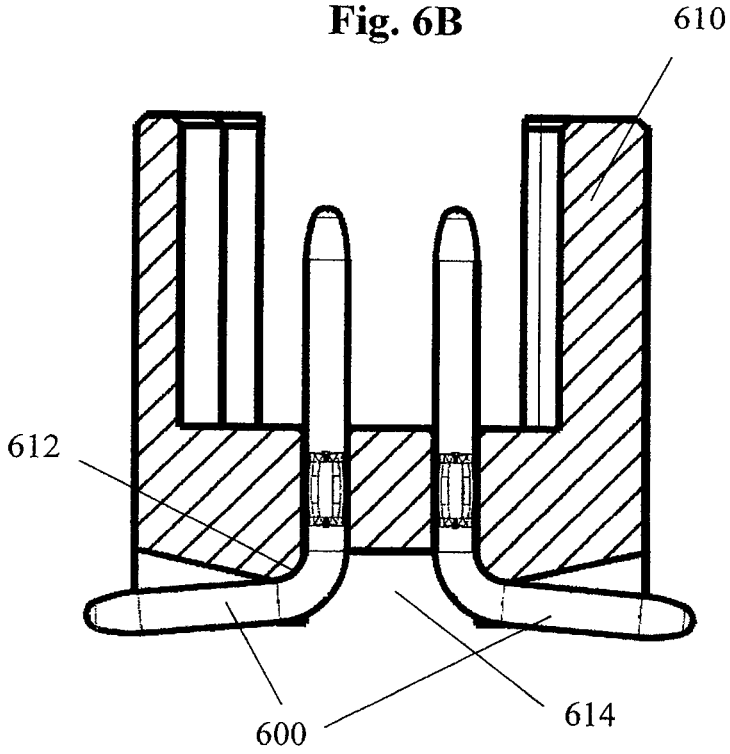
FIG. 6B shows a view of the male contact of FIG. 6 mounted in a housing.
Figure 6C:
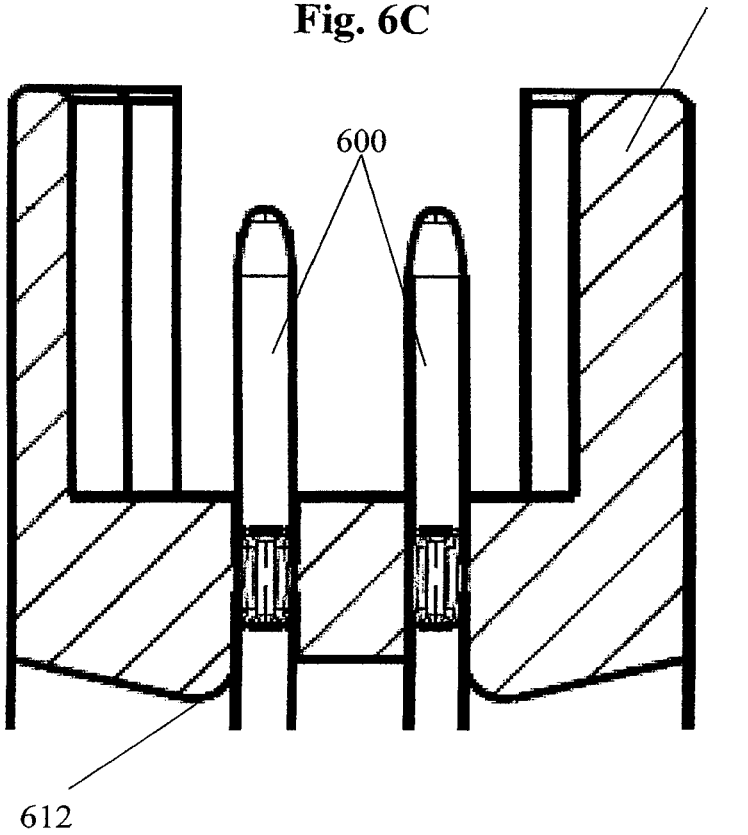
FIG. 6C shows another view of the male contact of FIG. 6 mounted in a housing.

Male contact 600 is particularly suited for use as a Surface Mount Tail (SMT) contact of the type known to the skilled person, but is not limited to use as a SMT contact. In FIG. 6B two male contacts 600 are shown secured in a housing 610, which will be described in detail later. Each male contact is an example of contact 600 described above and is substantially identical to the other. Each contact 600 is secured in housing 610 by the four point star arrangement discussed earlier, where each of protrusions 604*a*, 604*b* . . . is interference fit with a corresponding recess in housing 610.

As shown in FIG. 6B, a portion body 602 of contact 600 is bent in the plane perpendicular to its longitudinal axis to form an 'L' shape, as shown in FIG. 6B. Contact 600 is bent at a point close to the 'star' formed of protrusions 604*a*, 604*b* . . . and is preferably bent such that the angle between the longitudinal axis of contact 600 and the plane in which the bent portion (hereafter 'tail') of contact 600 sits is in the range of 85 to 90 degrees. The tail of contact 600 is then soldered to a PCB to form an electrical path. Preferably solder reflow techniques are used to solder the tail to the PCB, but other suitable securing means known to the skilled person may also be used. It is noted that the precise point at which contact 600 is bent is not crucial and should be chosen such that the tail is long enough to be soldered to the PCB securely to form a reliable electrical path. To allow any gasses generated during the soldering process to escape, housing 610 is raised up above the PCB (board stand off 614).

To allow the bending process to take place, housing 610 is provided with an edge 612 that abuts contact 600 when it is placed in housing 610. Edge 612 is preferably rounded, as shown most clearly in FIG. 6C. Edge 612 is used as a bending edge to bend the tail of contact 600 against. The provision of edge 612 allows contact 600 to be bent easily without requiring support from tooling during the bending process. This is advantageous as, on the scale of the innovative miniature contacts disclosed in the present specification, it is typically very difficult or even impossible to place tooling in a correct position to support contacts while they are being bent.

Figure 7:
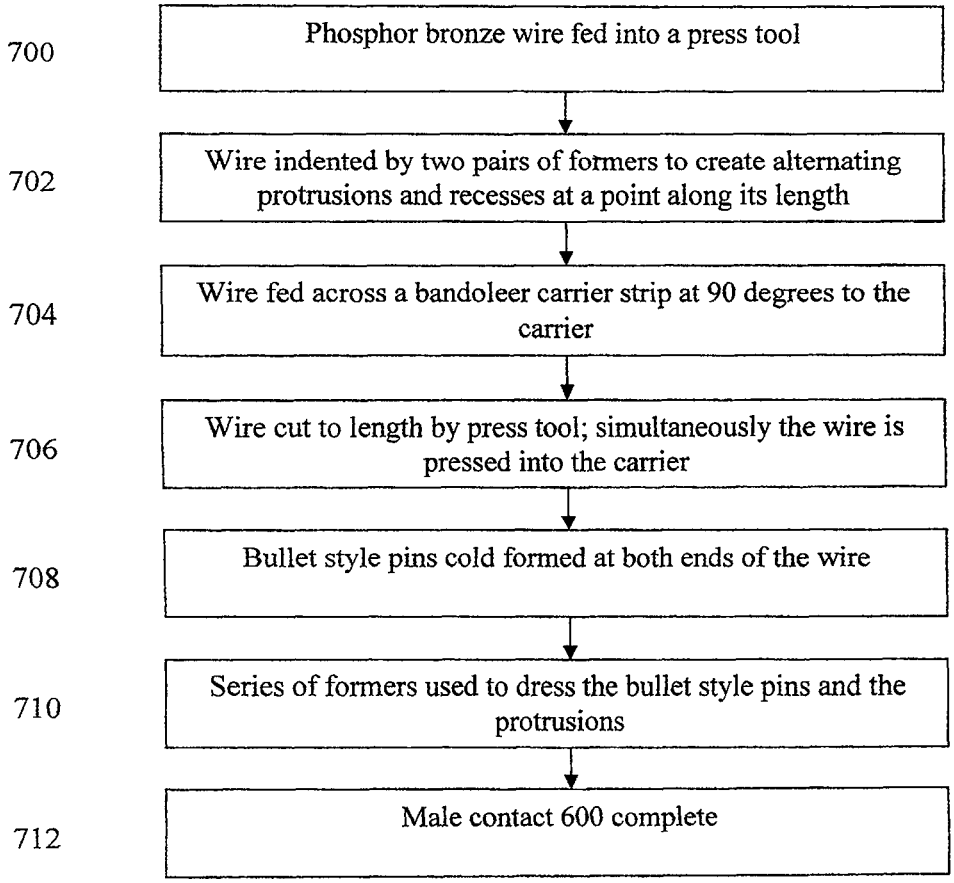
FIG. 7 is a flow diagram setting out the steps in a method for manufacturing the male contact of FIG. 6.

A method of manufacturing contact 600 is set out in FIG. 7. In step 700 a wire is fed into a press tool. In the present embodiment the wire is a phosphor bronze wire, but the wire may be formed from other materials. In step 702 the wire indented by two pairs of formers to create protrusions 604*a*, 604*b* . . . and recesses 606*a*, 606*b* . . . at a point along its length. The formers indent the wire to form recesses 606*a*, 606*b* . . . and the pressure of the formers on the wire causes the portions of the wire intermediate the formers to be forced outward to create protrusions 604*a*, 604*b* . . . .

In step 704 the wire is fed across a bandoleer carrier strip at 90 degrees to the carrier. Preferably the pitch of the contacts on the bandoleer is equal to the pitch of the holes in the connector that contact 600 will be inserted into, as this aids the automated assembly process. In particular, this allows an entire row of contacts to be inserted simultaneously into the connector using insertion heads in a so-called 'gang insertion' process. The wire is then cut to an appropriate length by the press tool in step 706, as well as simultaneously being pressed into the bandoleer carrier strip. In step 708, both ends of the wire (tip portions 608*a* and 608*b*) are cold formed into bullet style pins. Following this in step 710 a series of formers are used to dress the bullet style pins and the protrusions, such that the finished contact 600 is obtained in step 712.

A housing 800 according to the fifth embodiment that is suitable for securing the female contact 100 of the first embodiment and the male contact 500 of the third embodiment will now be described with reference to FIGS. 8, 8A, 8B, 8C, 8D, 8E, 8F and 8G.

Figure 8:
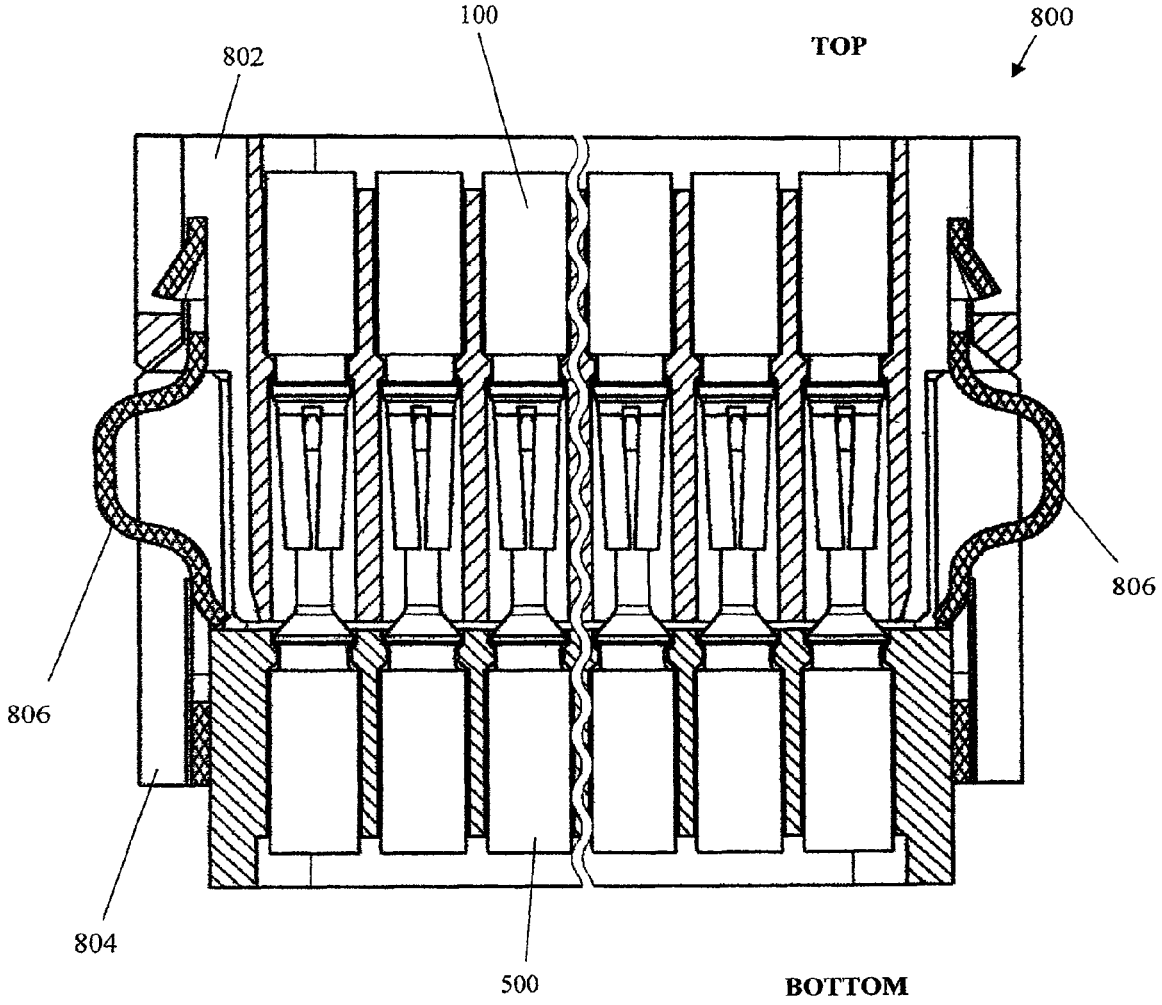
FIG. 8 shows a sectional view of two sides of a housing including a male connector mated with a female connector in accordance with a fifth embodiment.

FIG. 8 shows the side portions of a housing 800 having six female contacts 100 mated with six male contacts 500 within it. Only six female and male contacts are shown for ease of explanation but in this embodiment there will be four female and male contacts (not shown) between the side portions which are the same as those shown in FIG. 8 in order to provide the connectors with a row of ten contacts shown in FIGS. 8A to 8G. This is purely exemplary and any number of mated contacts may be provided within housing 800. In the present embodiment housing 800 is generally cuboidal, but other shapes may be used.

Figure 8A:
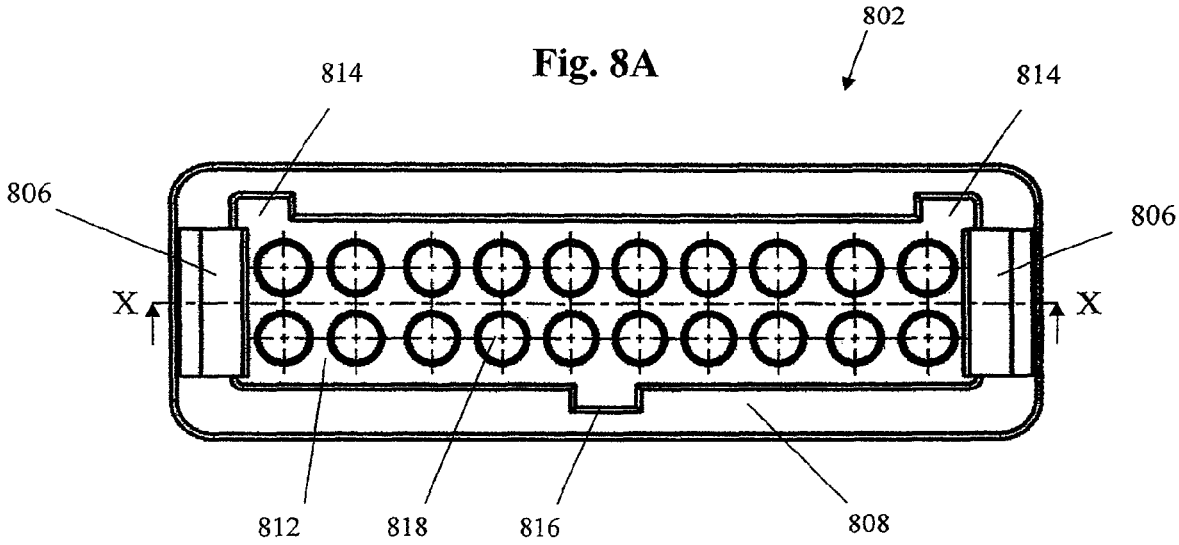
FIG. 8A is a bottom view of a male connector that forms part of the housing of FIG. 8.
Figure 8B:
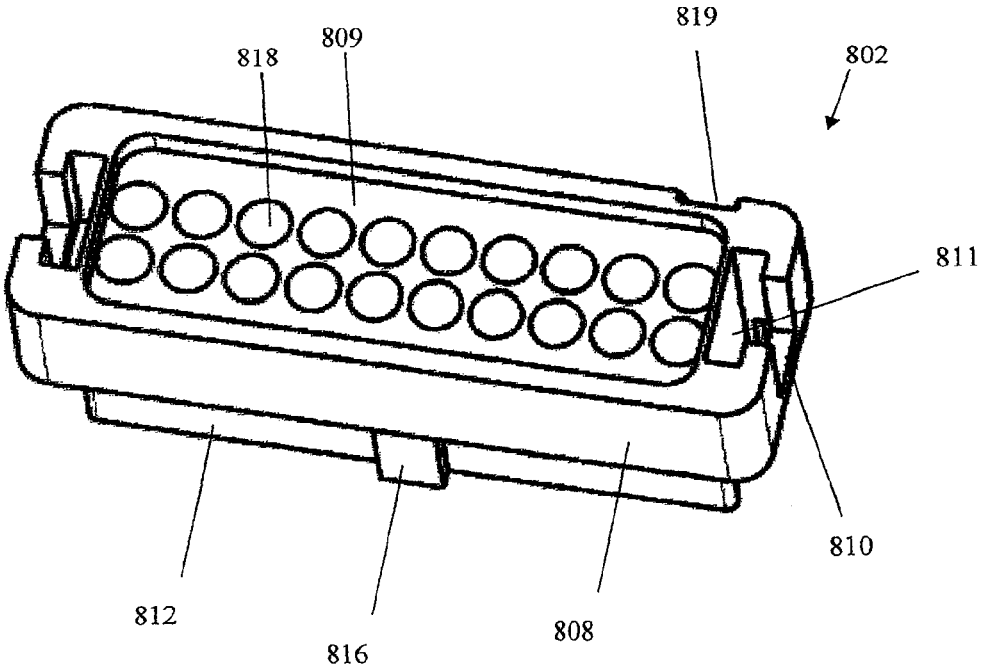
FIG. 8B is perspective view from the top of a male connector that forms part of the housing of FIG. 8.
Figure 8C:
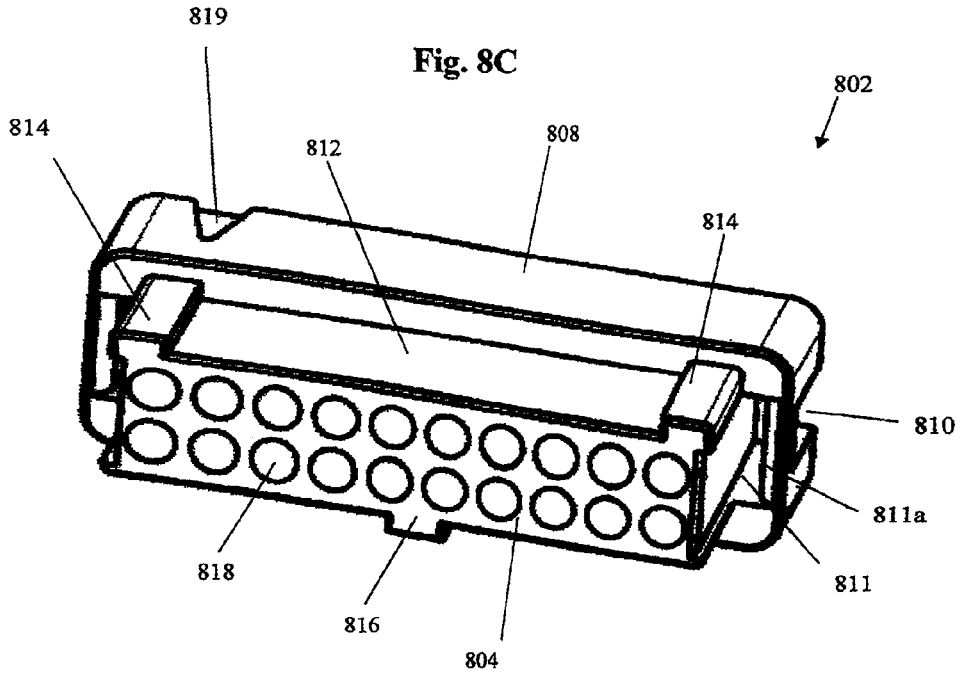
FIG. 8C is a perspective view from the bottom of a male connector that forms part of the housing of FIG. 8.

Housing 800 is formed of two distinct pieces; a male electrical connector 802 and a female electrical connector 804. The male connector is shown in FIGS. 8A to 8C and the female connector is shown in FIGS. 8D to 8G. These connectors are held together by latching mechanism which includes a pair of latches 806 (shown only in FIGS. 8A and 8E for reasons of clarity) that are positioned at either side end of housing 800. The latching mechanism enables male and female connectors 802, 804 to be releasably secured to each other and provides a mechanical connection between the two connectors that is in addition to the frictional mechanical connection that may be provided by the coupling of the male and female contacts of each male and female connector 802, 804. In FIG. 8 male connector 802 is shown housing female contact 100 of the first embodiment and female connector 804 is shown housing male contact 500 of the third embodiment, but this is purely exemplary and the reverse situation (female contact 100 in female connector 804 and male contact 500 in male connector 802) is also within the scope of the present invention. Therefore where contact 100 is referred to in the following description it is understood that this contact may be replaced by contact 500, with the reverse also being true.

The 'top' of housing 800 is defined to be the face of housing 800 that the back end of female contact 100 (i.e. the end of contact 100 from which a wire protrudes) is proximate when contacts 100 and 500 are secured in housing 800. This definition will be used throughout the following section in which connectors 802 and 804 and latches 806 are described in detail.

FIGS. 8A, 8B and 8C show male connector 802 that is capable of housing female contact 100 or male contact 500. In particular, FIG. 8A shows connector 802 from the bottom, FIG. 8B shows connector 802 in a perspective view from the top and FIG. 8C shows connector 802 in a perspective view from the bottom.

Connector 802 has a generally cuboidal top portion 808 that has rounded corners. Top portion 808 will be described as having two ends; these being the two smallest opposing faces of top portion 808. The top face of top portion 808 contains a recessed portion 809, in which holes 818 (described in more detail later) are present. In the present embodiment recessed portion 809 covers most of the top face of top portion 808 and is rectangular with rounded corners. This is not critical and other shapes and sizes for recessed portion 809 may be used.

A groove 810 (not shown in FIG. 8A) is formed in the top part of each end face of top portion 808. Groove 810 allows latch 806 to engage with top portion 808, as is described in more detail later. In the present embodiment groove 810 is rectangular, but other shaped arrangements may be used.

Two identical slotted potions 811 extend through the entire thickness of top portion 808 to create an air gap to accept latch 806. Each slotted portion 811 is positioned between groove 810 and the side wall of recessed portion 809, such that the overall profile of groove 810 and slotted portion 811 is 'T' shaped when connector 802 is viewed from directly above. Slotted portion 811 includes a tapered lip 811*a* (shown only in FIG. 8C) that is positioned at the bottom end of slotted portion 811, with lip 811*a* protruding slightly into slotted portion 811 so as to slightly decrease its cross-sectional area at its bottom end. Lip 811*a* serves as a lead in for neck portion 1000 of latch 806 when it is inserted into slotted portion 811 and also helps to deflect first locking portion 1004 of latch 806. This is described in more detail later in this specification.

The length and width of top portion 808 and connector 802 is not critical, but should be similar or equal to the length and width of connector 804, so that (as shown in FIG. 8) when the connectors are secured together the outer surfaces of both connectors are aligned. Preferably connector 802 is formed from polytetramethylene terephthalamide (PA 4T, also know as nylon 4T), which is a halogen free, red phosphorus free polymer. However, connector 802 may alternatively be made from any other suitable materials known to the skilled person.

Extending from the bottom face of top portion 808 is base portion 812. Base portion 812 is also generally cuboidal in shape but has a smaller area than top portion 808, such that it does not fully cover top portion 808 and in particular does not cover slotted portions 811. Base portion 812 is approximately centered on top portion 808; that is, the centre of base portion 812 is approximately in line with the centre of top portion 808. Both faces at the end of base portion 812 are recessed in order to accommodate latch 806, with the recesses in base portion 812 being aligned with the corresponding slotted portion 811 in top portion 808 to create a channel through connector 802 for latch 806.

The combined thickness of top portion 808 and base portion 812 is not crucial but should be chosen such that, as shown in FIG. 8, female contact 100 can fit fully within connector 802.

Protrusions 814 are present on two adjacent corners of base portion 812. In the present embodiment these take the form of cuboids having rounded corners, but other shapes may be used. A third protrusion 816 extends from the face of base portion 812 that is opposite the face including protrusions 814, with protrusion 816 being positioned at the mid-point of this face. In the present embodiment protrusion 816 is also cuboidal with rounded corners, but other shapes may be used. All three protrusions 814 and 816 extend along the entire thickness of base portion 812. These protrusions are provided to aid with the alignment of connector 802 when it is mated with another connector such as female connector 804 described later.

Any number of protrusions broadly similar to 814 and 816 may be provided and in any arrangement, but preferably an arrangement is chosen that is asymmetric with respect to the longitudinal axis X-X of connector 802 (i.e. such that connector 802 is a 'polarized' connector). This asymmetry allows the orientation of connector 802 to be absolutely determined, and ensures that it will only mate in one orientation with connector 802 (or 902), so that it is guaranteed that it will be mated in the correct orientation with respect to the orientation of connector 804 (or 904).

A potting wall is provided in base portion 812. This is so that, once contact 100 has been inserted into connector 802, a potting compound can be applied to provide a chemical bond between the connector and the insulated portion of the wire that is housed in contact 100. In particular, recessed portion 809 is filled with the potting compound after the contacts have been inserted into connector 802, where the lip of recessed portion 809 acts to contain the potting compound. This advantageously provides strain relief on the wire housed in the contact when it is secured in housing 800. In the present embodiment epoxy based resins or silicone compounds are used as a potting compound, but any suitable material known to the skilled person can be used.

Formed in the bottom face of base portion 812 are a series of holes 818 that receive contact 100. In the present embodiment each hole is circular, but other shapes may be used so long as contact 100 can fit snugly within the holes. Each hole 818 is the same as the others and each hole 818 extends all the way from the bottom face of base portion 812 through to the top face of top portion 808.

Any number of holes 818 can be used, although preferably one of 12, 16, 20 or 26 holes are present. In the present embodiment 20 holes are shown, with these being arranged in a regular 2×10 arrangement. This arrangement is purely exemplary and other arrangements of holes may be used. The diameter of each hole 818 is the same and is chosen such that female contact 100 will fit snugly within it.

In the present embodiment the internal profile (not shown) of holes 818 is generally cylindrical, but other shapes may be used. At a point along the length of each hole a protrusion is provided (not shown) around the entire circumference of hole 818. This is dimensioned to fit into recessed portion 119 of contact 100 (or equivalently recessed portion 514 of contact 500) so that when contact 100 (or 500) is inserted into hole 818 the protrusion in the hole aligns with and is accommodated by recessed portion 119 (or 514) of contact 100 (or 500). Preferably the width and extent of the protrusion in hole 818 is such that it fits tightly into recessed portion 119 (514) of contact 100 (500). The interaction between these two features serves to secure contact 100 (or 500) in place inside housing 800.

An identification mark 819 is optionally provided in the outer surface of connector 802 to indicate which of holes 818 will contain the 'first' contact, for reference when e.g. determining the orientation of housing 800. In the present embodiment identification mark 819 comprises a triangular cut-out in the outer surface of connector 802, but any other identification mark may be provided.

Figure 8D:
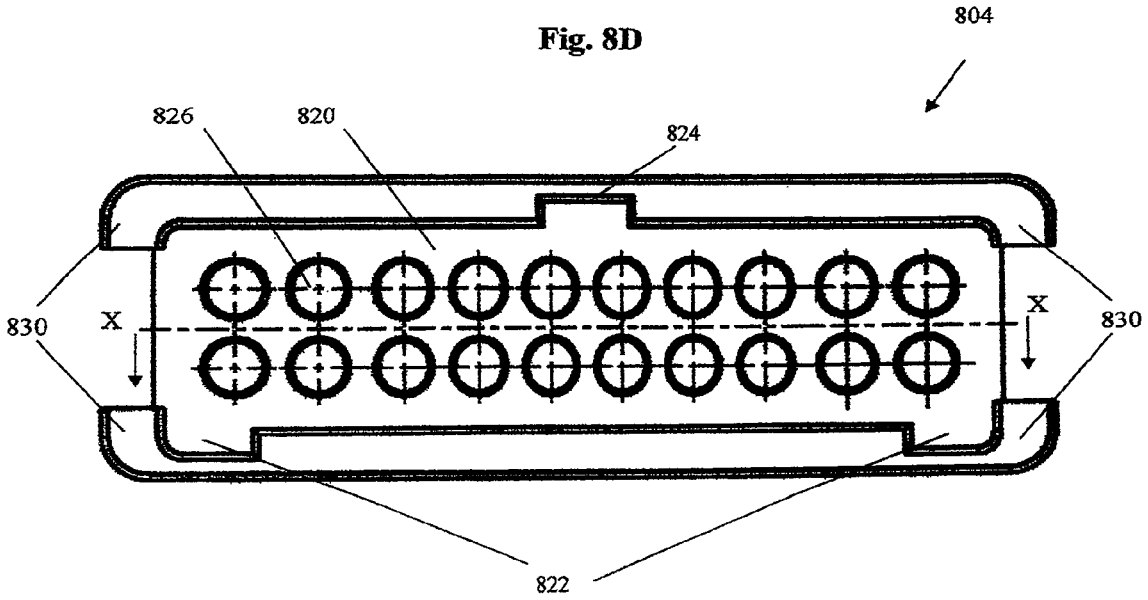
FIG. 8D is a top view of a female connector that forms part of the housing of FIG. 8.
Figure 8E:
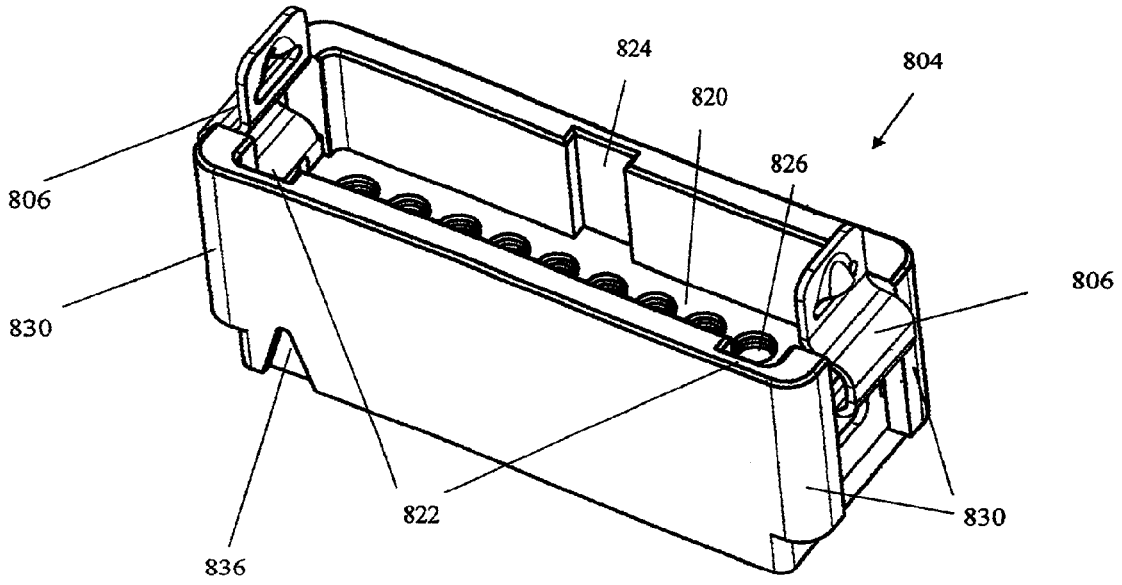
FIG. 8E is a perspective view from the top of a female connector that forms part of the housing of FIG. 8.
Figure 8F:
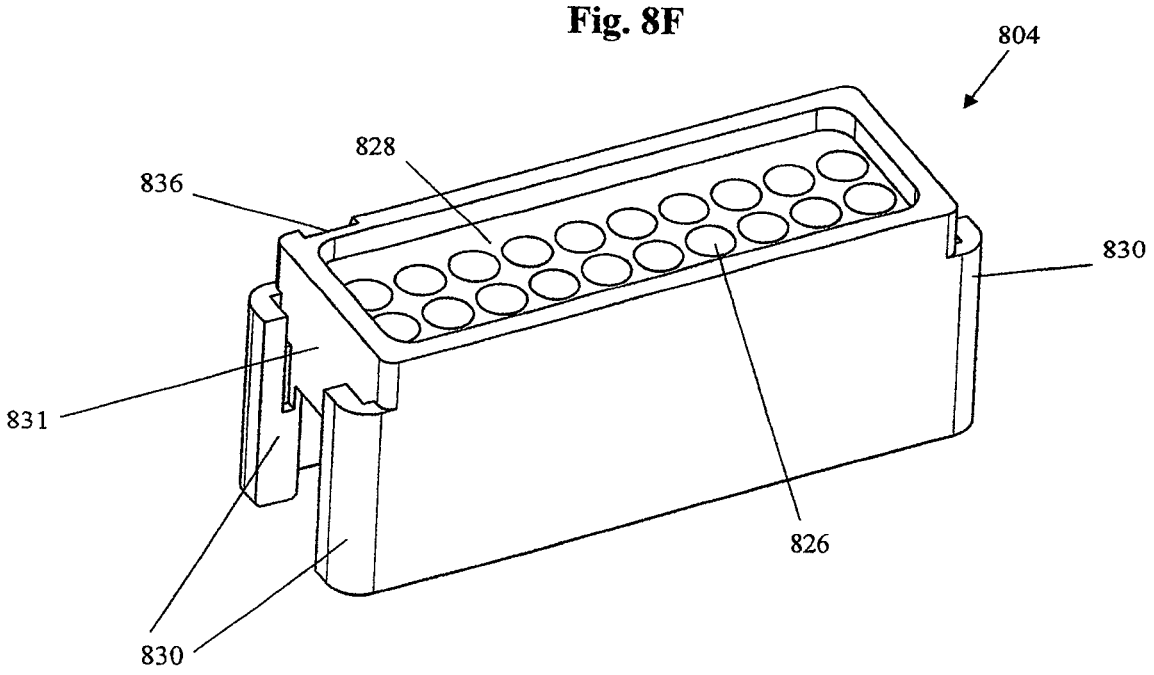
FIG. 8F is a perspective view from the bottom of a female connector that forms part of the housing of FIG. 8.

FIGS. 8D, 8E and 8F show female connector 804 that is capable of housing female contact 100 or male contact 500. In particular, FIG. 8D shows connector 804 in a plan view from the top, FIG. 8E shows connector 804 in a perspective view from the top and FIG. 8F shows connector 802 in a perspective view from the bottom. In the interests of clarity latches 806 are shown only in FIG. 8E. Female connector 804 is capable of mating with male connector 802 of the present embodiment or male connector 902 (described later).

As shown most clearly in FIG. 8E, female connector 804 comprises a generally cuboidal structure having rounded corners. A recessed portion 820 is present in the top face of connector 804. Recessed portion 820 has a profile such that base portion 812 will fit snugly within it; that is, the profile of recessed portion 820 is the negative of base portion 812. The length and width of connector 804 is not critical but is preferably equal or similar to that of top portion 808 of connector 802, so that (as shown in FIG. 8) when the connectors are secured together the outer surfaces of both connectors are aligned. Preferably connector 804 is formed from polytetramethylene terephthalamide (PA 4T, also know as nylon 4T) which is a halogen free and red phosphorus free polymer. However, connector 804 may alternatively be made from any other suitable materials known to the skilled person.

A groove 822 is provided two adjacent corners of recessed portion 820, with these grooves being designed to accept protrusions 814 of base portion 812. Similarly a third groove 824 is provided at the mid-point of the face of recessed portion 820 that is opposite the face having grooves 822 at its corners; this groove 824 is provided to accept protrusion 816 of base portion 812. Holes 826 are provided in recessed portion 820, with these holes being positioned and dimensioned such that they align with holes 818 in connector 802 when the two connectors are fitted together as shown in FIG. 8. This alignment serves to provide a passage through the entire thickness of housing 800 into which contacts 100 and 500 can be inserted and mated.

Any number of grooves broadly similar to 822 and 824 may be provided and in any arrangement, but preferably an arrangement is chosen that is asymmetric with respect to the longitudinal axis of connector 804 (i.e. such that connector 804 is a 'polarized' connector). This asymmetry allows the orientation of connector 804 to be absolutely determined and ensures that it will only mate in one orientation with connector 802 (or 902), so that it is guaranteed that it will be mated in the correct orientation with respect to the orientation of connector 802 (or 902).

A recessed portion 828 is also present in the bottom face of connector 804, in which holes 826 are provided. In the present embodiment recessed portion 828 is rectangular with rounded corners, but other shapes may also be used.

In the present embodiment the internal profile of holes 826 is generally cylindrical, but other shapes may be used. At a point along the length of each hole a protrusion is provided (not shown) around the entire circumference of hole 826. This is set out as the negative of recessed portion 119 of contact 100 (or equivalently the negative of recessed portion 514 of contact 500) so that when contact 100 (or 500) is inserted into hole 818 the protrusion in the hole aligns with and is accommodated by recessed portion 119 (or 514) of contact 100 (or 500).

Preferably the width and extent of the protrusion in hole 818 is such that it fits tightly into recessed portion 119 (or 514) of contact 100 (or 500). In the present embodiment the protrusion in hole 826 is similar to that provided in hole 818, so that connector 804 may also interchangeably accommodate female contact 100 or male contact 500.

Figure 8G:
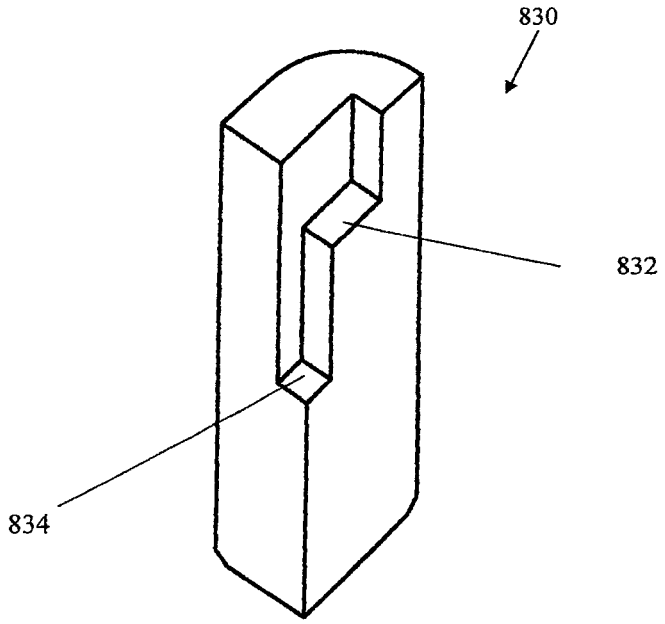
FIG. 8G is a perspective view of a portion of the female connector of FIGS. 8D-8F.

At each end of connector 804 are a pair of curved protrusions 830, shown in FIG. 8G in detail. These protrusions 830 are to hold latches 806 in place against the end faces of connectors 802 and 804. Each of protrusions 830 is the same as the others, so only one will be described in detail. Further, both end faces of connector 804 are the same as each other, so only one is described in detail.

Protrusion 830 extends from a rounded corner of end face 831 and is then curved through approximately 90 degrees, such that the bottom face of protrusion 830 is substantially 'r' shaped. In the present embodiment protrusion 830 extends from the top face of connector 804 along approximately 50% of its thickness, but this is not critical and protrusions of other lengths may also be used so long as they assist in securing latches 806 against the end faces of connectors 802 and 804.

The cross-section of protrusion 830 is only substantially 'r' shaped along the lower quarter of its thickness, as shown most clearly in FIG. 8G. This results in an air gap being present between the curved portion of protrusion 830 and end face 831 of connector 804 from which it extends. The majority of latch 806 is positioned in this air gap when connector 804 is secured to connector 802 to form housing 800.

The second quarter (as measured from the bottom of connector 804) of protrusion 830 has a cross-section of a rectangle having one rounded corner, where a small square segment has been removed from the corner of the rectangle that is opposite the rounded corner. This cross-section serves to provide a first surface 832 a quarter of the way along protrusion 830 (measured from the bottom of protrusion 830). First surface 832 is substantially planar and abuts arm 1016 of latch 806, as described later, to ensure latch 806 is positioned correctly.

The remaining portion of protrusion 830 has a cross-section like the second quarter, except that the square segment that has been removed is smaller than in the case of the second quarter. This cross-section serves to provide a second surface 834 approximately half way along protrusion 830 (measured from the bottom of protrusion 830). Second surface 834 is substantially planar and abuts shoulder 1012 of latch 806, as described later, to ensure latch 806 is positioned correctly.

The upper half of protrusion 830 has the cross-section of a rectangle having one rounded corner. This results in a second surface 834 being present half way along the length of protrusion 830. Second surface 834 abuts shoulder 1012 of latch 806, as described later, also to ensure latch 806 is positioned correctly.

It will be apparent that the above spacing (first surface 832 at a quarter of the length of protrusion 830 and second surface 834 being approximately half way along the length of protrusion 830) is not critical to the present invention, and any other arrangement having differently spaced surfaces, more or less surfaces or equivalent features is also within the scope of the present invention. Alternative arrangements should however be chosen such that they co-operate with latch 806 (or an equivalent) to ensure that it is secured against the end face of connector 804.

End face 831 of connector 804 is not flat. Instead, a lower portion of end face 831 extends outward from connector 804 by a small amount at a point approximately at the mid-point of the length end face 831 (shown only in FIG. 11). The lower portion extends outward across the entire width of end face 831, and all the way to its bottom face. This creates a tapered lip (shown as lip 1100 in FIG. 11) that second locking protrusion 1010 of latch 806 abuts when in place, serving to lock latch 806 in place.

An identification mark 836 is optionally provided in the outer surface of connector 804 to indicate which of holes 818 will contain the 'first' contact, for reference when e.g. determining the orientation of housing 800. In the present embodiment identification mark 832 is the same as identification mark 819 optionally provided in connector 802, but any other identification mark may be provided.

Connectors 802 and 804 are preferably packaged in tape and reel packaging (not shown) for automatic placement onto a PCB, where each connector sits in a tape pocket in the packaging.

Figure 9:
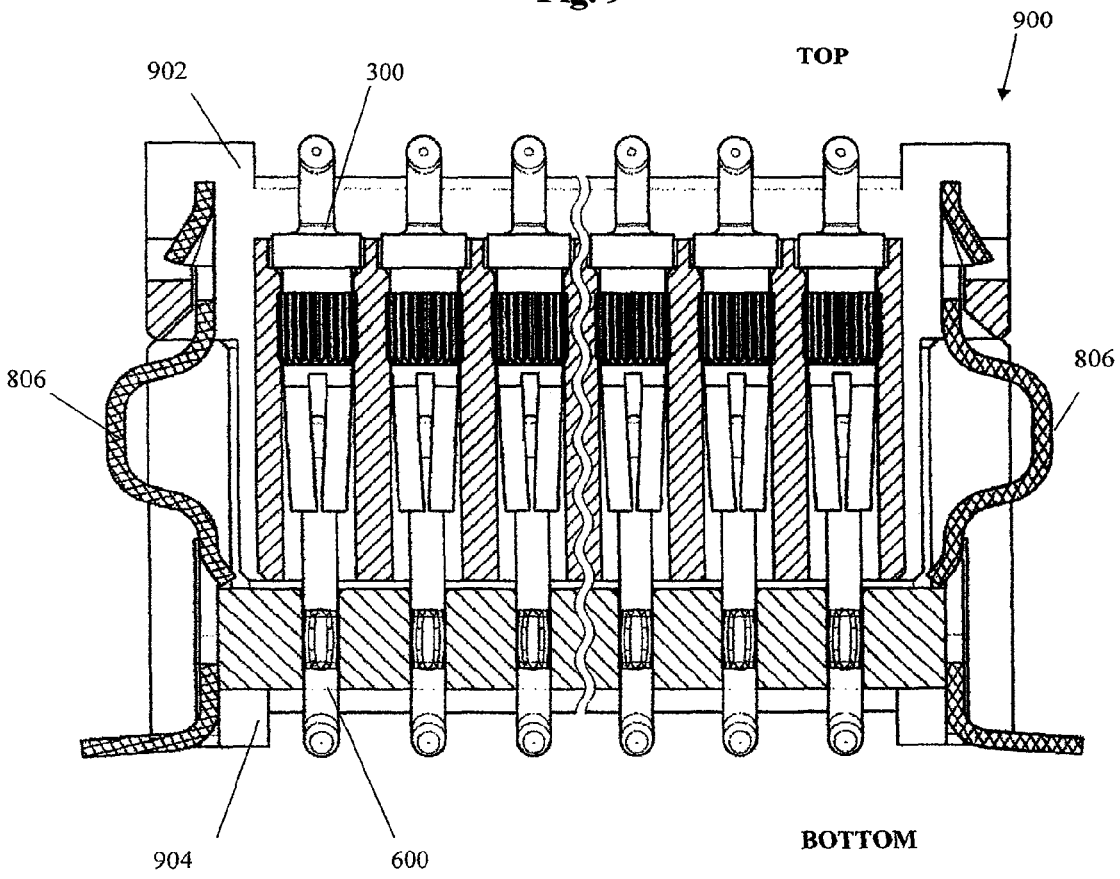
FIG. 9 shows sectional view of two sides of a housing including a male connector mated with a female connector in accordance with a sixth embodiment.
Figure 9A:
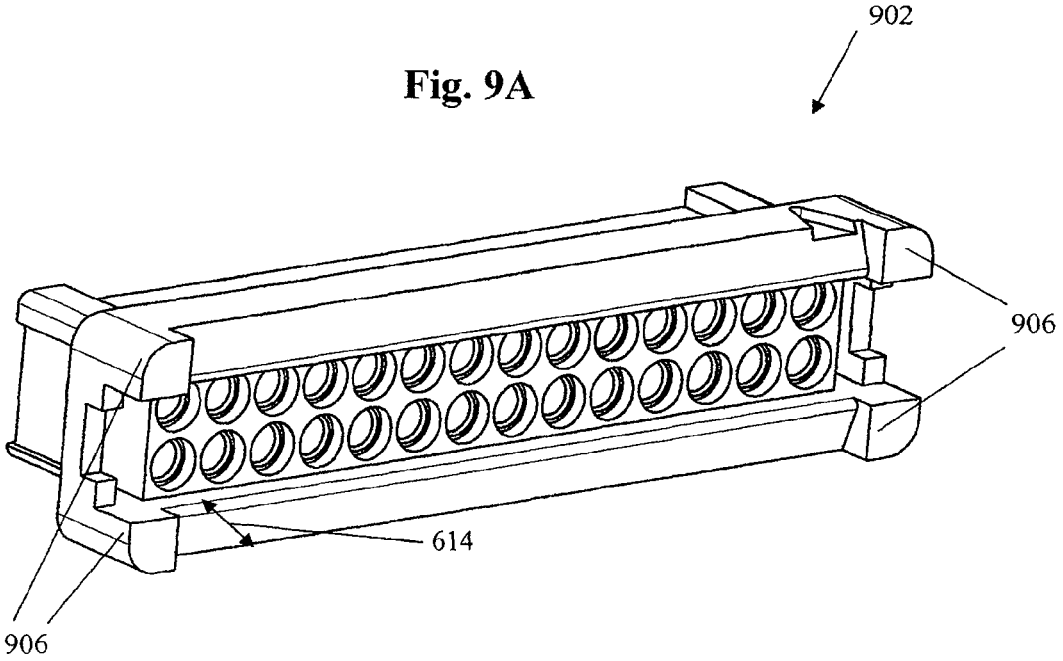
FIG. 9A is a perspective view from the bottom of a male connector that forms part of the housing of FIG. 9.
Figure 9B:
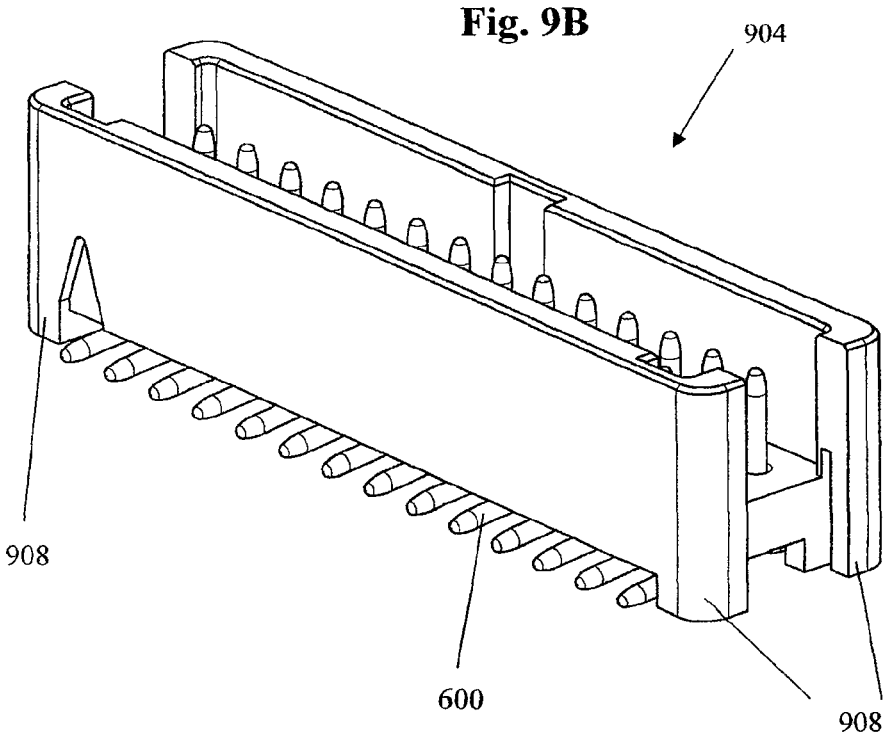
FIG. 9B is a perspective view from the top of a female connector that forms part of the housing of FIG. 9.

A housing 900 for housing the female contact 300 of the second embodiment and the male contact 600 of the fourth embodiment is shown in FIGS. 9, 9A and 9B. Housing 900 is substantially similar to housing 800 of the fifth embodiment, so in the interests of brevity only the differences between the housing 800 and housing 900 are described below.

FIG. 9 shows side portions of a housing 900 having six female contacts 300 mated with six male contacts 600 within it. Only six female and male contacts are shown for ease of explanation but in this embodiment there will be eight female and male contacts (not shown) between the side portions which are the same as those shown in FIG. 9 in order to provide the connectors with a row of fourteen contacts shown in FIGS. 9A to 9B. This is purely exemplary and any number of mated contacts may be provided within housing 900. Housing 900 is formed of two pieces; a male electrical connector 902 and a female electrical connector 904. These are substantially similar to male electrical connector 802 and female electrical connector 804 of the fifth embodiment, other than as described below.

FIG. 9A shows male connector 902 according to the sixth embodiment of the present invention (note that latches 806 are not shown for clarity). This is the same as male connector 802 of the fifth embodiment except that the rounded corners of the top portion of connector 902 (c.f. top portion 808 of connector 802) extend out beyond the top face of the top portion of the connector 902 to form legs 906. Legs 906 are of sufficient length such that, when connector 902 rests on them on a flat surface, legs 906 cause connector 902 to be raised up so that tail 315*a* of contact 300 or body 602 of contact 600 can extend out from under the connector. Legs 906 are therefore preferably at least as long as the diameter of tail 315*a* or body 602. This allows the bent arrangement shown in FIG. 6B to be achieved. Legs 906 also serve to create stand off 614, which as described earlier with reference to FIG. 6B allows gasses created during soldering to escape.

Connector 902 also includes a bending edge (not shown) similar to bending edge 612 described earlier. This is arranged on the top face of connector 902.

FIG. 9B shows female connector 904 according to the sixth embodiment of the present invention (note that latches 806 are not shown for clarity). Connector 904 is the same as connector 804 of the fifth embodiment except that legs 908 are provided in a similar manner to legs 906 on connector 902. In addition connector 904 also includes a bending edge (not shown) similar to bending edge 612 described earlier. This is arranged on the bottom face of connector 902.

Connectors 902 and 904 are preferably packaged in tape and reel packaging for automatic placement onto a PCB, where each connector sits in a tape pocket in the packaging. Both male connector 902 and female connector 904 make use of a 'pick and place cap', which is used to transport the connector 902 or 904 from the tape pocket to their final position on the PCB. The pick and place cap is then removed after the connector has been soldered to the PCB.

It is noted that the present invention is not limited to housings having the connector combinations shown in FIGS. 8 and 9; rather, the similarities between male connectors 802 and 902 and female connectors 804 and 904 mean that a housing could equally be formed from male connector 802 and female connector 904, or female connector 804 and male connector 902, without departing from the scope of the present invention. It will be appreciated that the number of holes in each connector will need to be equal and the connectors can be adapted accordingly.

In accordance with a seventh embodiment of the present invention latch 806 that is used to secure connectors 802 and 804 together, or to secure connectors 902 and 904 together, or to secure connectors 802 and 904 together, or to secure connectors 804 and 902 together, will now be described with reference to FIGS. 10 and 11.

Figure 10:
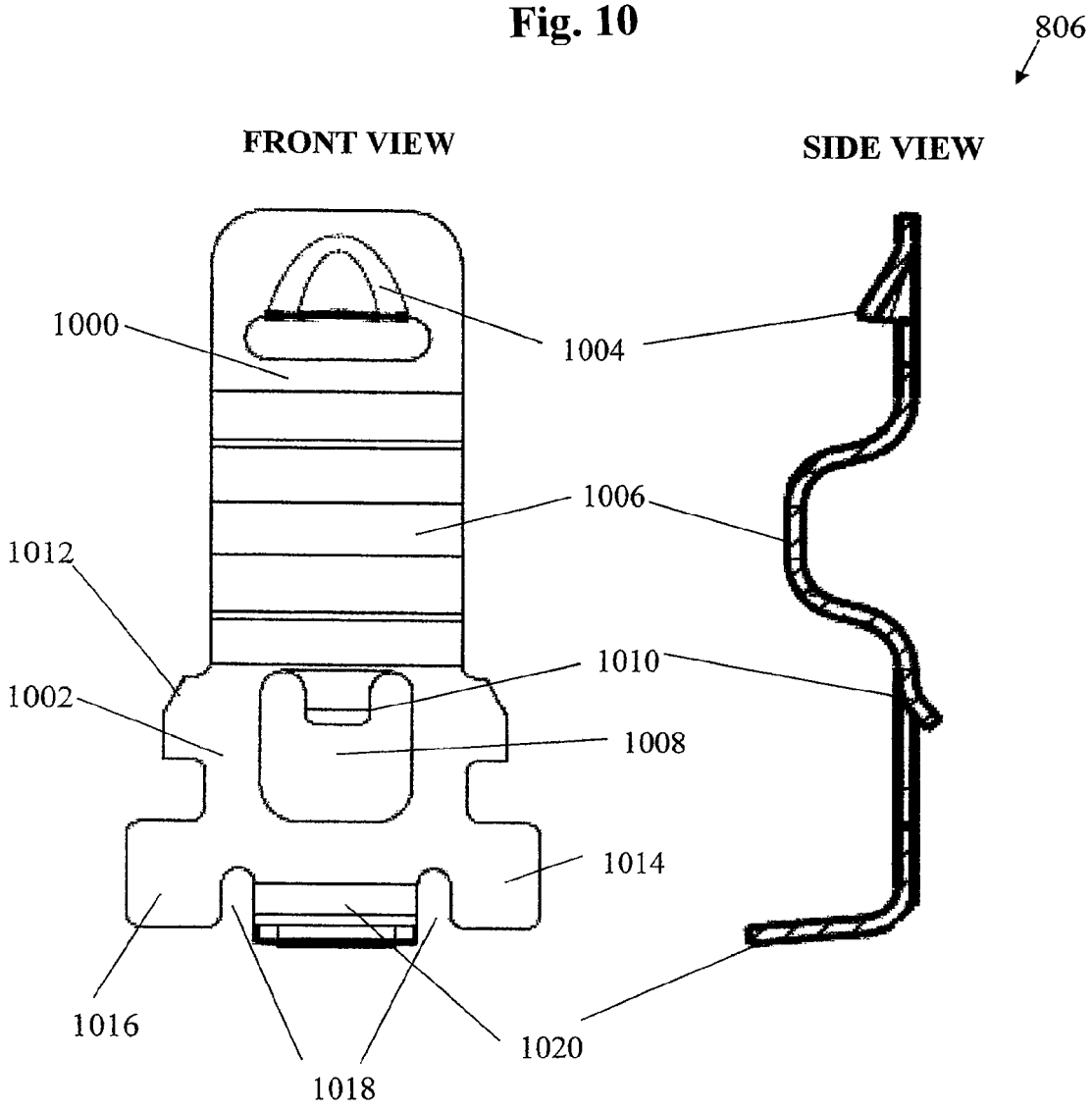
FIG. 10 shows a front and side view of a latch according to a seventh embodiment that may be used with the housing of FIG. 8 or FIG. 9.
Figure 11:
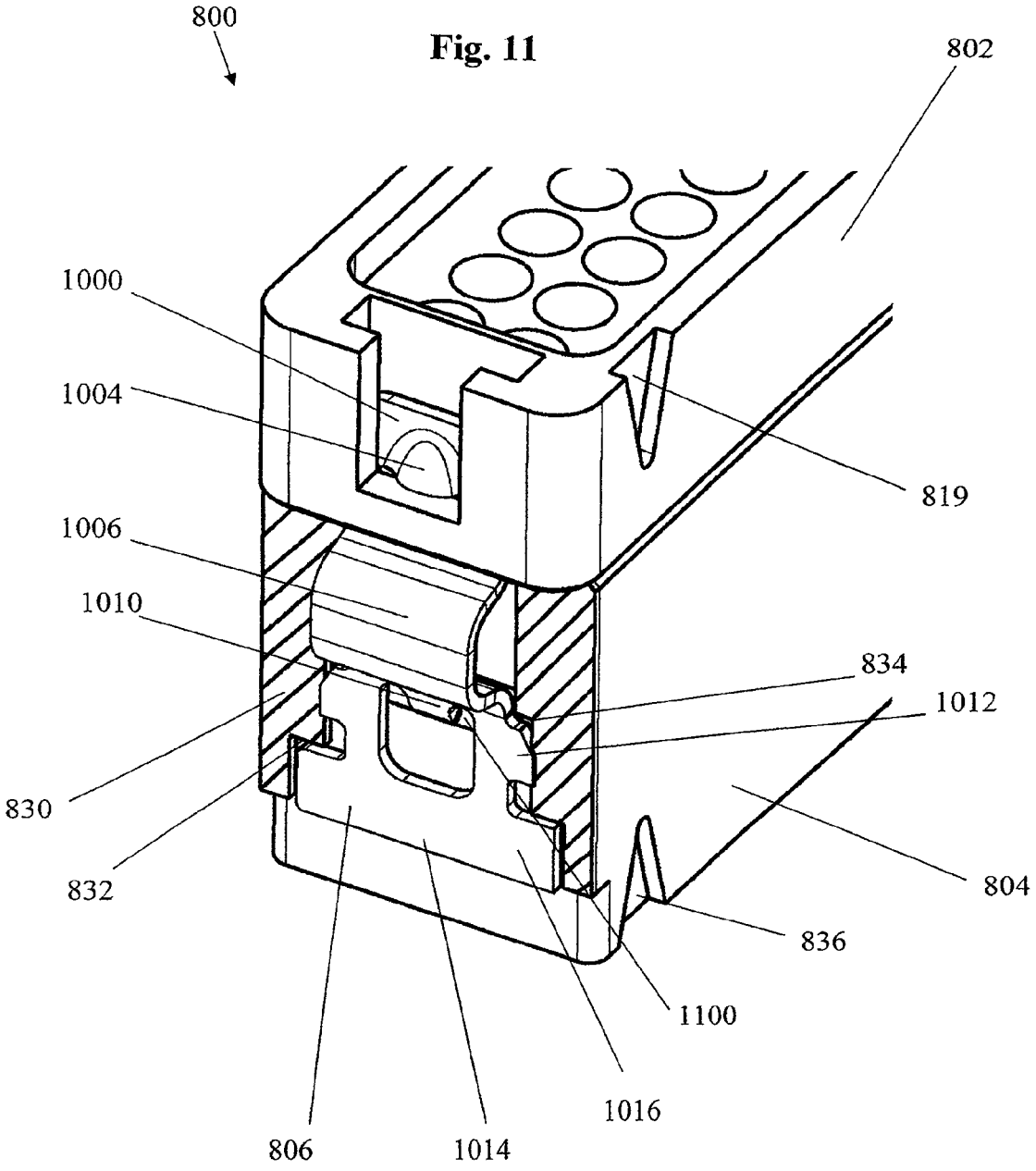
FIG. 11 shows a perspective view of the latch of FIG. 10 when inserted into the housing of FIG. 8.

FIG. 10 shows a front and side view of latch 806 according to a seventh embodiment of the present invention. FIG. 11 shows a perspective view of latch 806 in use securing male connector 802 and female connector 804 together. Protrusions 830 are not shown in FIG. 11 for clarity.

Latch 806 is formed from a single strip of material that is shaped by chemical etching, photo chemical machining or stamping by a stamping tool. These manufacturing processes are well known to the skilled person and will not be described in detail here. Once the main body of latch 806 has been formed using one of these techniques, parts are cold formed using a series of formers and punches to produce the final profile of latch 806. During the manufacturing process latch 806 is attached to a bandoleer, which allows it to be progressed through the stamping or forming tools. The bandoleer is then removed during automated assembly of housing 800. It will be appreciated that this method is only one exemplary method for forming latch 806 and other suitable techniques for forming latch 806 known to the skilled person may also be used.

Preferably latch 806 is formed from one or more copper alloys or from stainless steel, such that it is resiliently deformable. However the present invention is not limited to these materials and other resiliently deformable materials known to the skilled person may also be used for latch 806.

For convenience latch 806 is described as having a neck portion 1000 and a body portion 1002. However, this is merely for ease of description and should not be taken to suggest or imply that latch 806 is formed of more than one piece of material. In addition, latch 806 will be described with reference to male connector 802 and female connector 804 of the fifth embodiment, but this is by way of example only and latch 806 can equally be used to secure male connector 902 and female connector 904 together.

In the present embodiment neck portion 1000 of latch 806 is a rectangular sheet of material having a thickness that is significantly less than its length and breadth. Neck portion 1000 is joined to body portion 1002 at one end. The two corners of neck portion 1000 that are distal the end that is joined to body portion 1002 are rounded. This end of neck portion 1000 will be hereafter referred to as the 'distal' end of neck portion 1000.

A first locking protrusion 1004 is located near the distal end of neck portion 1000. First locking protrusion 1004 comprises a piece of neck portion 1000 that is tapered and bent out the plane in which body portion 1002 sits, as is most clearly shown in the side view of FIG. 10. First locking protrusion 1004 is resiliently deformable. First locking protrusion 1004 is connected towards the distal end of neck portion 1000, such that the tapered section of first locking protrusion 1004 is presented to slotted portion 811 when latch 806 is in use. This allows neck portion 1000 to slide easily into slotted portion 811, as described in the next paragraph.

In use the distal end of neck portion 1000 is aligned with and then fed into slotted portion 811 of connector 802. This feeding motion causes first locking protrusion 1004 to be pushed towards the plane of body portion 1002 by lip 811*a* of slotted portion 811, such that the distal end of neck portion 1000 can proceed into slotted portion 811 without being impeded by first locking protrusion 1004. The taper of first locking protrusion 1004 is preferably chosen to promote (or at least not inhibit) the sliding of neck portion 1000 into slotted portion 811.

Once neck portion 1000 has been fed far enough into slotted portion 811, lip 811*a* is no longer in contact with first locking protrusion 1004 and so first locking protrusion 1004 springs back into its original position out of the plane of body 1002. This results in the edge of first locking protrusion 1004 that is distal neck portion 1000 abutting the bottom edge of groove 810 in male connector 802 to hold connector 802 in place. This is as shown in FIG. 11. Preferably groove 810 is at least as wide as locking protrusion 1004 so that the entire distal edge of first locking protrusion 1004 abuts groove 810. In addition, preferably the thickness of slotted portion 811 is just greater than the thickness of neck portion 1000, such that the distal end of neck portion 1000 snugly fits into slotted portion 811.

The section of neck portion 1000 that is between first locking protrusion 1004 and body portion 1000 extends out of the plane of body portion 1002 at its distal end in the same direction as first locking protrusion 1004 and returns to the plane of body portion 1000 at its proximate end, so as to form a depressible elevated portion 1006. As best shown in the side view of FIG. 10, in the present embodiment elevated portion 1006 has the shape of a 'U' turned by 90 degrees onto its side, but this shape is not crucial and any other shape may be used as long as it allows a portion along the length of latch 806 to extend beyond the outer edge of housing 800 (or 900), so that this portion can be depressed to separate connectors 802 and 804 or connectors 902 and 904.

Body portion 1002 of latch 806 has the basic shape of a pair of abutting rectangles. The first of these two rectangular sections abuts neck portion 1000 and has the same width as neck portion 1000. The mid-points of first and second rectangular sections and neck portion 1000 are all aligned along a single 'vertical' axis, such that latch 806 is symmetric about this vertical axis. This axis will be hereafter referred to as the vertical axis of latch 806.

A rectangular through hole 1008 is provided in the centre of the first rectangular section; in the present embodiment this extends along almost the entire length of the first rectangular section and across approximately one half of its width, but this is exemplary only and other shapes and sizes may be used for through hole 1008.

Extending from the edge of through hole 1008 that is proximate neck portion 1000 is a substantially rectangular second locking protrusion 1010. As best shown in the side view of FIG. 10, second locking protrusion 1010 is curved along its length such that it extends out of the plane of body portion 1002, but in the opposite direction to that in which first locking protrusion 1004 and elevated portion 1006 extend. In use, the entire edge of second locking protrusion 1010 that is distal body portion 1002 abuts lip 1100 to secure connectors 802 and 804 together. The co-operation of second locking portion 1010 and lip 1100 is particularly advantageous as it prevents latch 806 from coming loose under vibration.

A shoulder 1012 extends from each side edge of the first rectangle in the plane of body portion 1002. Each shoulder 1012 is approximately half the length of the first rectangular section of body portion 1002. In use, as shown in FIG. 11 shoulder 1012 is interference fit with second surface 834 of protrusion 830 of female connector 804. This serves as an easy and effective way to align latch 806 in connector 804, as well as providing additional means (i.e. supplemental to first and second locking protrusions 1004 and 1010) for retaining latch 806 in connector 804.

The second rectangular section 1014 of body portion 1002 abuts the first rectangular portion at the edge distal from neck portion 1000. Second rectangular section 1014 is wider than first rectangular section, so that two arm portions 1016 are formed. Arm portions 1016 extend beyond the edge of first rectangular portion and preferably, as shown in FIG. 10, arm portions 1016 also extend beyond shoulders 1012. In use the edges of arm portions 1016 that are distal the first rectangular portion can be used to push latch 806 into the air gap present between the curved portion of protrusion 830 and end face 831 of connector 804. Each arm portion 1016 abuts first surface 832 of protrusion 830 of connector 804 to form a positive stop mechanism to prevent latch 806 from being over-inserted.

The edge of second rectangular section 1014 that is distal the first rectangular section includes two inverted 'U' shaped cut-outs 1018. These are symmetrically positioned about the vertical axis of latch 806, with each cut-out 1018 being positioned between arm portion 1016 and a surface mount pad 1020 that is also formed on the edge of second rectangular section 1014 that is distal the first rectangular section and that is centered on the vertical axis of latch 806. Surface mount pad 1020 is generally rectangular and is curved through approximately 90 degrees to extend out of the plane of body portion 1002 in the same direction as depressible elevated portion 1006 and first locking protrusion 1004. Surface mount pad 1020 is used to secure latch 806 to PCB (not shown). Cut-outs 1018 are provided so that, during manufacture, surface mount pad 1020 can be bent into its final position out of the plane of body portion 1002 without unwanted distortions being formed in the region of body portion 1002 that surrounds surface mount pad 1020.

The method by which two latches are used to secure connectors 802 and 804 together (or equivalently connectors 902 and 904) is as follows. The operation of one latch at one end of connectors 802 and 804 is described, but it will be understood that the same operation takes place simultaneously with a second (identical) latch at the other end of connectors 802 and 804.

Firstly, latch 806 is fed neck portion 1000 first into the air gap present between the curved portion of protrusion 830 and end face 831 of connector 804. Latch 806 is pushed into this air gap by applying force to the edges of arm portions 1016, as mentioned earlier. Force is applied until shoulders 1012 abut second surface 834 of protrusion 830 and arms 1016 abut first surface 832 of protrusion 830. Latch 806 is secured in this position by second locking protrusion 1010 abutting against lip 1100. This arrangement also results in the distal end of neck portion 1000 of latch 806 being pressed against end face 831 of connector 804. This contact between end face 831 and latch 806 is advantageous as it prevents latch 806 from being damaged by overstressing when in use.

When latch 806 is correctly in place the distal end of neck portion 1000 (including first locking portion 1004) will protrude from and extend beyond the top edge of connector 804 (as shown in FIG. 8E). Connector 802 is then slotted into connector 804, with the base portion 812 of connector 802 being placed within and accepted by the recessed portion 820 of connector 802. During this motion the distal end of neck portion 1000 is fed into slotted portion 811 of connector 802 such that first locking portion 1004 abuts the bottom edge of groove 810 to hold connector 802 in place. Connectors 802 and 804 are then held together as housing 800, as shown in FIG. 8. During this motion first locking protrusion 1004 is pressed into the plane of body portion 1002 by lip 811*a* and then subsequently springs back into its original position, as described in detail earlier in this specification.

When connectors 802 and 804 are to be released, force is applied to elevated portion 1006 in the direction towards the plane of body portion 1002; that is, elevated portion 1006 is depressed. This causes first locking protrusion 1004 to disengage from groove 810, such that connector 802 can be lifted off from connector 804 to separate the two connectors. Force is preferably applied to both latches substantially simultaneously, such that both disengage at approximately the same time. This separation is simple, effective and does not require the use of special tooling designed specifically for this purpose. Such specialist tooling is typically very difficult to position correctly to release coupled connectors, and particularly coupled miniature connectors; this is a problem as, if the specialist tooling is not positioned correctly, it can easily damage a latching mechanism by overstressing it and even breaking a portion of it off when an attempt is made to release the connectors.

In addition, the latch design described herein is compact, unobtrusive, effective and relatively simple to manufacture, all of which significantly contribute to the effective operation of the miniature housing of the present invention. Known latching mechanisms typically require the use of a nut and bolt assembly or a complex system of springs and levers which can be both bulky and expensive to manufacture. The latch design of the present embodiment avoids the need to make use of such complex and costly components.

Figure 12:
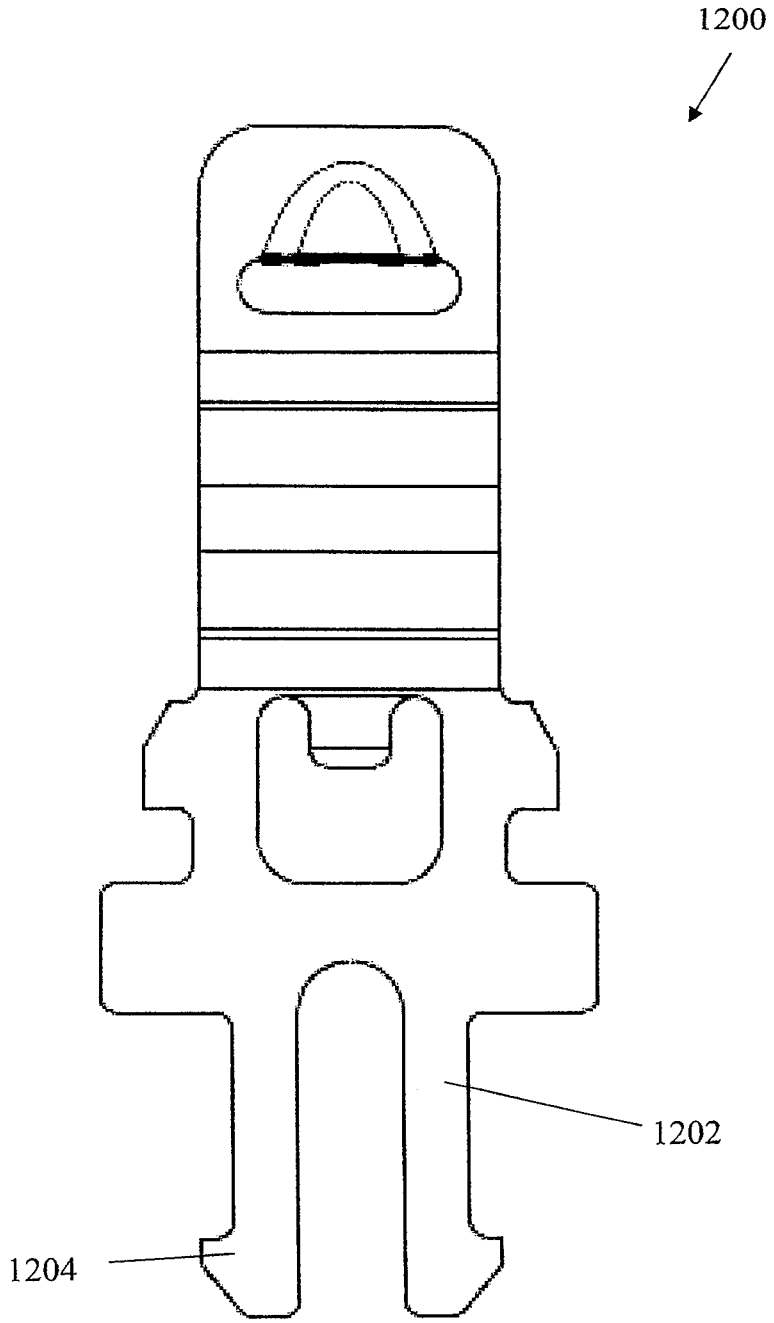
FIG. 12 shows a front view of a latch according to an eighth embodiment that may be used with the housing of FIG. 8 or FIG. 9.

FIG. 12 shows an alternative latch 1200 according to an eighth embodiment of the present invention. Latch 1200 may be used as an alternative to latch 806. Latch 1200 is the same as latch 806 except that, in place of cut-outs 1018 and surface mount pad 1020 latch 1200 has through board legs 1202. Through board legs 1202 are rectangular and extend away from the body portion of latch 1200. At the end of each through board leg 1202 distal the body portion of latch 1200 is a foot 1204 having a hooked portion. Through board legs 1202 and feet 1204 are used to secure latch 1200 to a PCB.

The operation of latch 1200 is the same as latch 806 and so will not be described in detail here. Latch 1200 offers at least the same advantages noted earlier in respect of latch 806.

Figure 13:
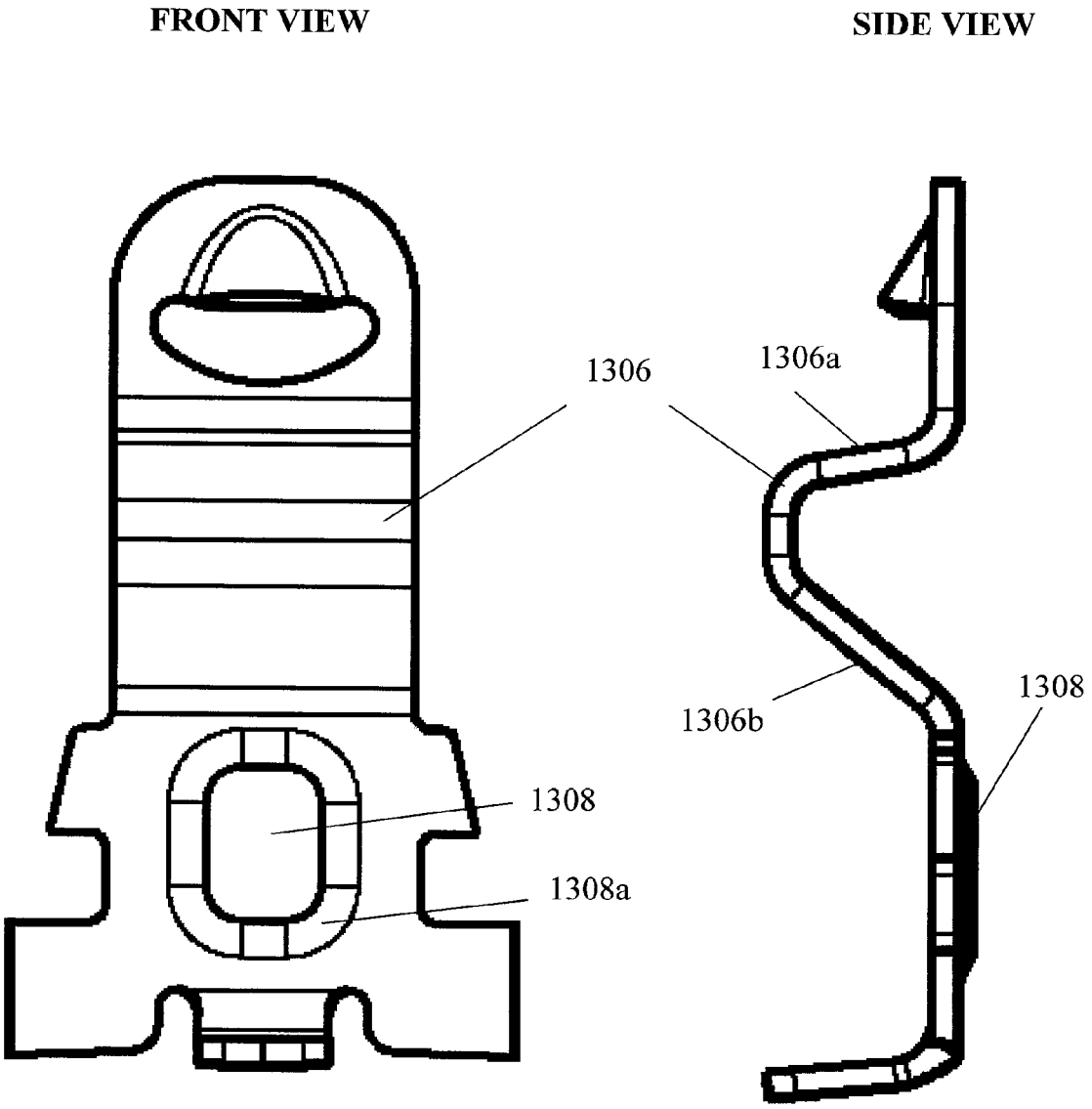
FIG. 13 shows a front and side view of a latch according to a ninth embodiment that may be used with the housing of FIG. 8 or FIG. 9.

FIG. 13 shows another alternative latch 1300 according to a ninth embodiment of the present invention. Latch 1300 may be used as an alternative to latch 806. Latch 1300 is the same as latch 806 except as follows.

Firstly, latch 1300 includes depressible elevated portion 1306 that has a different profile to elevated portion 1006 of latch 806. In particular, the upper portion 1306*a* of elevated portion 1306 is arranged such that the acute angle between it and the plane of latch 1300 is in the range of 75 to 90 degrees, inclusive, and more preferably approximately 80 degrees. The lower portion 1306*b* of elevated portion 1306 is arranged such that the acute angle between it and the plane of latch 1300 is preferably in the range of 30 and 60 degrees inclusive, and more preferably is approximately equal to 45 degrees. This arrangement has been found to reduce the force required to depress elevated portion 1306 when separating connector 802 from connector 804, resulting in an easier to use separation mechanism.

Secondly, in place of through hole 1008 and second locking protrusion 1010, latch 1300 includes a depression 1308 having a substantially flat base and rounded edges 1308*a*, such that the depression 1308 is shaped somewhat like a flat bottomed bowl. The depth of depression 1308 is preferably chosen such that, as shown in the side view of FIG. 13, the base of depression 1308 protrudes slightly beyond the back face of latch 1300. This arrangement has been found to increase the overall strength of latch 1300 whilst also making it easier to insert latch 1300 into the end of a pair of connectors like connectors 802 and 804 or connectors 902 and 904.

In addition to the embodiments of the invention described in detail above, the skilled person will recognize that various features described herein can be modified and combined with additional features, and the resulting additional embodiments of the invention are also within the scope of the invention.

The invention claimed is:

1. A method of manufacturing a female electrical contact from a single piece of material by removal of material from the piece of material by machining, the removal of material comprising the steps of:

forming by removal of material at least one first hole in a first end of a single piece of material to form a contact portion, the at least one first hole formed along a longitudinal axis of the material;

making at least two slits in the contact portion to produce contact fingers, the slits extending from the first end along at least a portion of length of the contact portion; and bending the contact fingers towards the longitudinal axis of the contact.

2. The method of claim 1, wherein the piece of material is bar stock.

3. The method of claim 1, wherein the at least one first hole is formed by drilling.

4. The method of claim 1, wherein the at least one first hole is cylindrical.

5. The method of claim 1, wherein said at least two slits are made at substantially ninety degrees to the other to quarter the contact portion, and wherein the point at which the slits intersect one another lies along the longitudinal axis of the contact.

6. The method of claim 1, wherein the contact is a miniature contact.

7. The method of claim 1, wherein the bending step includes:

sliding a tapered sleeve over the contact fingers to cause them to bend towards the longitudinal axis of the contact.

8. The method of claim 1, wherein each finger is uniformly bent towards the longitudinal axis of the contact.

9. The method of claim 1, including the further steps of:

forming at least one second hole in the piece of material at the end that is distal the contact portion, wherein the at least one second hole is centered along the longitudinal axis of the contact;

forming a through hole to connect the at least one first hole with the at least one second hole; and plating at least one interior surface of the contact via the through hole.

10. A single piece female electrical contact having a contact portion, wherein the contact portion is formed by removing material from a piece of starting material by machining, the contact portion comprising at least one first hole at a first end of the material along a longitudinal axis of the contact portion and at least two slits in the contact portion to produce contact fingers, the slits extending from the first end along at least a portion of length of the contact portion, wherein the contact fingers are bent towards the first end of the longitudinal axis of the contact.

11. The single piece female electrical contact of claim 10, wherein the contact is a miniature electrical contact.

12. The single piece female electrical contact of claim 10, wherein the contact includes a through hole, the through hole connecting the at least one first hole to at least one second hole to form a channel through the interior of the contact.

* * * * *